US009707563B2

(12) United States Patent
Li et al.

(10) Patent No.: US 9,707,563 B2
(45) Date of Patent: Jul. 18, 2017

(54) REAGENT FLUID DISPENSING DEVICE, AND METHOD OF DISPENSING A REAGENT FLUID

(75) Inventors: Mo-Huang Li, Singapore (SG); Jackie Y. Ying, Singapore (SG); Guolin Xu, Singapore (SG); Yoke San Daniel Lee, Singapore (SG); Emril Mohamed Ali, Singapore (SG); Tseng-Ming Hsieh, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 394 days.

(21) Appl. No.: 13/696,063

(22) PCT Filed: May 4, 2011

(86) PCT No.: PCT/SG2011/000174
§ 371 (c)(1),
(2), (4) Date: Jan. 22, 2013

(87) PCT Pub. No.: WO2011/139234
PCT Pub. Date: Nov. 10, 2011

(65) Prior Publication Data

US 2013/0136671 A1 May 30, 2013

(30) Foreign Application Priority Data

May 4, 2010 (SG) ..... 201003158-1

(51) Int. Cl.
*B01L 3/00* (2006.01)
*B01L 3/02* (2006.01)
*F04F 1/18* (2006.01)

(52) U.S. Cl.
CPC . *B01L 3/52* (2013.01); *F04F 1/18* (2013.01)

(58) Field of Classification Search
None
See application file for complete search history.

(56) References Cited

U.S. PATENT DOCUMENTS 6,322,683 B1 * 11/2001 Wolk et al. ..... 204/600
6,521,188 B1 2/2003 Webster
(Continued)

FOREIGN PATENT DOCUMENTS

CN 101208256 A 6/2008
EP 2 163 306 A1 3/2010
(Continued)

OTHER PUBLICATIONS

PCT International Search Report for PCT Counterpart Application No. PCT/SG2011/000174, 5 pgs., (Jul. 12, 2011).
(Continued)

*Primary Examiner* — Jill Warden
*Assistant Examiner* — Julie Tavares
(74) *Attorney, Agent, or Firm* — Blakely, Sokoloff, Taylor & Zafman LLP

(57) ABSTRACT

According to various embodiments, a reagent fluid dispensing device may be provided. The reagent fluid dispensing device may include a chamber for receiving a reagent fluid, the chamber having a first opening and a second opening; a first fluid conduit connected to the first opening of the chamber; a reservoir connected to the first fluid conduit, the reservoir having a first opening, wherein the first opening of the reservoir is connected to the first fluid conduit to form a passive valve, wherein the reservoir is dimensionalized for storing a predetermined volume of the reagent fluid; and a pneumatic conduit connected to the second opening of the chamber, wherein selective application of pneumatic pressure to the chamber through the pneumatic conduit transfers the reagent fluid from the reservoir to the chamber through the first fluid conduit. According to various embodiments, a microfluidic device including the reagent fluid dispensing device, and a method of dispensing a reagent fluid may be provided.

17 Claims, 21 Drawing Sheets

(56) References Cited

U.S. PATENT DOCUMENTS

| | | | | |
|---|---|---|---|---|
| 2004/0037739 | A1* | 2/2004 | McNeely | B01F 5/10 422/417 |
| 2004/0109793 | A1* | 6/2004 | McNeely et al. | 422/100 |
| 2007/0259109 | A1* | 11/2007 | Sorndal | 427/240 |
| 2009/0325159 | A1 | 12/2009 | Zeng | |
| 2010/0064781 | A1* | 3/2010 | Cherubini et al. | 73/64.56 |
| 2013/0056112 | A1 | 3/2013 | Hovinen et al. | |

FOREIGN PATENT DOCUMENTS

| | | | |
|---|---|---|---|
| WO | WO 01/57509 | A1 | 8/2001 |
| WO | WO 2005/066066 | A1 | 7/2005 |
| WO | WO 2006/014140 | A1 | 2/2006 |
| WO | WO 2009/072987 | A1 | 6/2009 |
| WO | WO 2009/123565 | A1 | 10/2009 |

OTHER PUBLICATIONS

PCT Written Opinion of the International Searching Authority for PCT Counterpart Application No. PCT/SG2011/000174, 6 pgs., (Jul. 12, 2011).

PCT Notification concerning Transmittal of International Preliminary Report on Patentability (Chapter I of the Patent Cooperation Treaty) for PCT Counterpart Application No. PCT/SG2011/000174, 8 pgs., (Nov. 15, 2012).

First Office Action for corresponding Chinese Patent Application No. 201180031812.7, 16 pages (including English translation), (Feb. 8, 2014).

Joanna S. Ellis, et al., "Molecular Diagnosis of Influenza", Rev. Med. Virol., vol. 12, pp. 375-389, (2002).

Srikumar Sengupta, et al., "Molecular Detection and Identification of Influenza Viruses by Oligonucleotide Microarray Hybridization", Journal of Clinical Microbiology, vol. 41, No. 10, pp. 4542-4550, (Oct. 2003).

Nicole Kessler, et al., "Use of the DNA Flow-Thru Chip, a Three-Dimensional Biochip, for Typing and Subtyping of Influenza Viruses", Journal of Clinical Microbiology, vol. 42, No. 5, pp. 2173-2185, (May 2004).

Robin Hui Liu, et al., "Self-Contained, Fully Integrated Biochip for Sample Preparation, Polymerase Chain Reaction Amplification, and DNA Microarray Detection", Analytical Chemistry, vol. 76, No. 7, pp. 1824-1831, (Apr. 1, 2004).

Chih-Sheng Johnson Hou, et al., "Integrated Microelectronic Device for Label-Free Nucleic Acid Amplification and Detection", Lab Chip, vol. 7, pp. 347-354, (2007).

R. Pal, et al., "An Integrated Microfluidic Device for Influenza and other Genetic Analyses", Lab Chip, vol. 5, pp. 1024-1032, (2005).

Curtis D. Chin, et al., "Lab-on-a-Chip Devices for Global Health: Past Studies and Future Opportunities", Lab Chip, vol. 7, pp. 41-57, (2007).

Bernhard Weigl, et al., "Towards Non- and Minimally Instrumented, Microfluidics-Based Diagnostic Devices", Lab Chip, vol. 8, pp. 1999-2014, (2008).

Jaephil Do, et al., "Development of Functional Lab-on-a-Chip on Polymer for Point-of-Care Testing of Metabolic Parameters", Lab Chip, vol. 8, pp. 2113-2120, (2008).

P.-A. Auroux, et al., "Miniaturised Nucleic Acid Analysis", Lab Chip, vol. 4, pp. 534-546, (2004).

Yoon-Kyoung Cho, et al., "One-Step Pathogen Specific DNA Extraction from Whole Blood on a Centrifugal Microfluidic Device", Lab Chip, vol. 7, pp. 565-573, (2007).

Michael C. Breadmore, et al., "Microchip-Based Purification of DNA from Biological Samples", Analytical Chemistry, vol. 75, No. 8, pp. 1880-1886, (Apr. 15, 2003).

Ying Huang, et al., "MEMS-Based Sample Preparation for Molecular Diagnostics", Anal. Bioanal. Chem., vol. 372, pp. 49-65, (2002).

Chien-Ju Liu, et al., "Magnetic-Bead-Based Microfluidic System for Ribonucleic Acid Extraction and Reverse Transcription Processes", Biomed. Microdevices, vol. 11, pp. 339-350, (2009).

Agustin González Crevillén, et al., "Real Sample Analysis on Microfluidic Devices", Talanta, vol. 74, pp. 342-357, (2007).

Soo Hyun Lee, et al., "A Polymer Lab-on-a-Chip for Reverse Transcription (RT)-PCR Based Point-of-Care Clinical Diagnostics", Lab Chip, vol. 8, pp. 2121-2127, (2008).

Chunsun Zhang, et al., "Miniaturized PCR Chips for Nucleic Acid Amplification and Analysis: Latest Advances and Future Trends", Nucleic Acids Research, vol. 35, No. 13, pp. 4223-4237, (2007).

Chunsun Zhang, et al., "PCR Microfluidic Devices for DNA Amplification", Biotechnology Advances, vol. 24, pp. 243-284, (2006).

Chia-Sheng Liao, et al., "Miniature RT-PCR System for Diagnosis of RNA-Based Viruses", Nucleic Acids Research, vol. 33, No. 18, e156, 7 pgs., (2005).

Jing Wang, et al., "A Disposable Microfluidic Cassette for DNA Amplification and Detection", Lab Chip, vol. 6, pp. 46-53, (2006).

Jeong-Gun Lee, et al., "Microchip-Based One Step DNA Extraction and Real-Time PCR in One Chamber for Rapid Pathogen Identification", Lab Chip, vol. 6, pp. 886-895, (2006).

Juergen Pipper, et al., "Catching Bird Flu in a Droplet", Nature Medicine, vol. 13, No. 10, pp. 1259-1263, (Oct. 2007).

Ivan K. Dimov, et al., "Integrated Microfluidic tmRNA Purification and Real-Time NASBA Device for Molecular Diagnostics", Lab Chip, vol. 8, pp. 2071-2078, (2008).

Kang-Yi Lien, et al., "Integrated Reverse Transcription Polymerase Chain Reaction Systems for Virus Detection", Biosensors and Bioelectronics, vol. 22, pp. 1739-1748, (2007).

Lin Chen, et al., "Total Nucleic Acid Analysis Integrated on Microfluidic Devices", Lab Chip, vol. 7, pp. 1413-1423, (2007).

Fei Zhou, et al., "Identification of 20 Common Human Enterovirus Serotypes by Use of a Reverse Transcription-PCR-Based Reverse Line Blot Hybridization Assay", Journal of Clinical Microbiology, vol. 47, No. 9, pp. 2737-2743, (Sep. 2009).

Stanley Tam, et al., "Fluorescence-Based Multiplex Real-Time RT-PCR Arrays for the Detection and Serotype Determination of Foot-and-Mouth Disease Virus", Journal of Virological Methods, vol. 161, pp. 183-191, (2009).

World Health Organization, "WHO Information for Laboratory Diagnosis of Pandemic (H1N1) 2009 Virus in Humans—Revised", retrieved from the Internet: http://www.who.int/csr/resources/publications/swineflu/diagnostic_recommendations/en/, 49 pgs., (Nov. 23, 2009).

Hong Kai Lee, et al., "Diagnostic Testing for Pandemic Influenza in Singapore: A Novel Dual-Gene Quantitative Real-Time RT-PCR for the Detection of Influenza A/H1N1/2009", Journal of Molecular Diagnostics, vol. 12, No. 5, pp. 636-643, (Sep. 2010).

David T. Eddington, et al., "Flow Control with Hydrogels", Advanced Drug Delivery Reviews, vol. 56, pp. 199-210, (2004).

Dennis R. Sparkman, "Paraffin Wax as a Vapor Barrier for the PCR", Genome Res., vol. 2, pp. 180-181, (1992).

Benoît Hébert, et al., "Increased PCR Sensitivity by using Paraffin Wax as a Reaction Mix Overlay", Molecular and Cellular Probes, vol. 7, pp. 249-252, (1993).

Alain Glière, et al., "Modeling and Fabrication of Capillary Stop Valves for Planar Microfluidic Systems", Sensors and Actuators A, vols. 130-131, pp. 601-608, (2006).

Aniruddha Puntambekar, et al., "Fixed-Volume Metering Microdispenser Module", Lab Chip, vol. 2, pp. 213-218, (2002).

Jonathan West, et al., "Silicon microstructure arrays for DNA extraction by solid phase sample contacting at high flow rates", Sensors and Actuators B, vol. 126, pp. 664-671, (2007).

Patrick N. Ngatchou, et al., "A Real-Time PCR Analyzer Compatible with High-Throughput Automated Processing of 2-μL Reactions in Glass Capillaries", IEEE Transactions on Automation Science and Engineering, vol. 3, No. 2, pp. 141-151, (Apr. 2006).

A. Rida, et al., "Manipulation of Self-Assembled Structures of Magnetic Beads for Microfluidic Mixing and Assaying", Analytical Chemistry, vol. 76, No. 21, pp. 6239-6246, (Nov. 1, 2004).

Kelvin K.W. To, et al., "Viral Load in Patients Infected with Pandemic H1N1 2009 Influenza A Virus", Journal of Medical Virology, vol. 82, pp. 1-7, (2010).

James B. Mahony, et al., "Cost Analysis of Multiplex PCR Testing for Diagnosing Respiratory Virus Infections", Journal of Clinical Microbiology, vol. 47, No. 9, pp. 2812-2817, (Sep. 2009).

(56) References Cited

OTHER PUBLICATIONS

Frédéric Raymond, et al., "Comparison of Automated Microarray Detection with Real-Time PCR Assays for Detection of Respiratory Viruses in Specimens Obtained from Children", Journal of Clinical Microbiology, vol. 47, No. 3, pp. 743-750, (Mar. 2009).
Marc Madou, et al., "Lab on a CD", Annual Review of Biochemical Engineering, vol. 8, pp. 601-628, (2006).

* cited by examiner

FIG. 3A
(I)
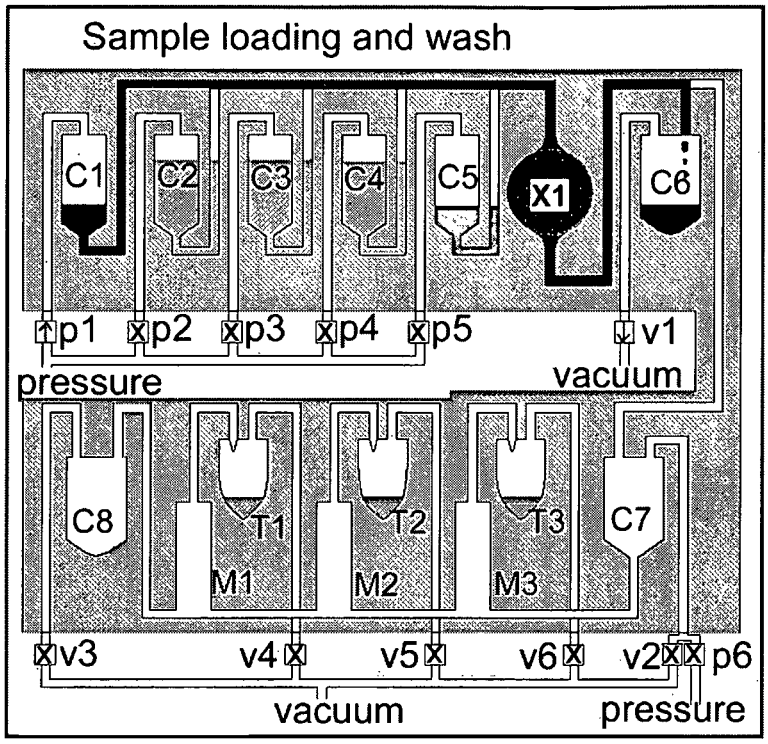
(II)
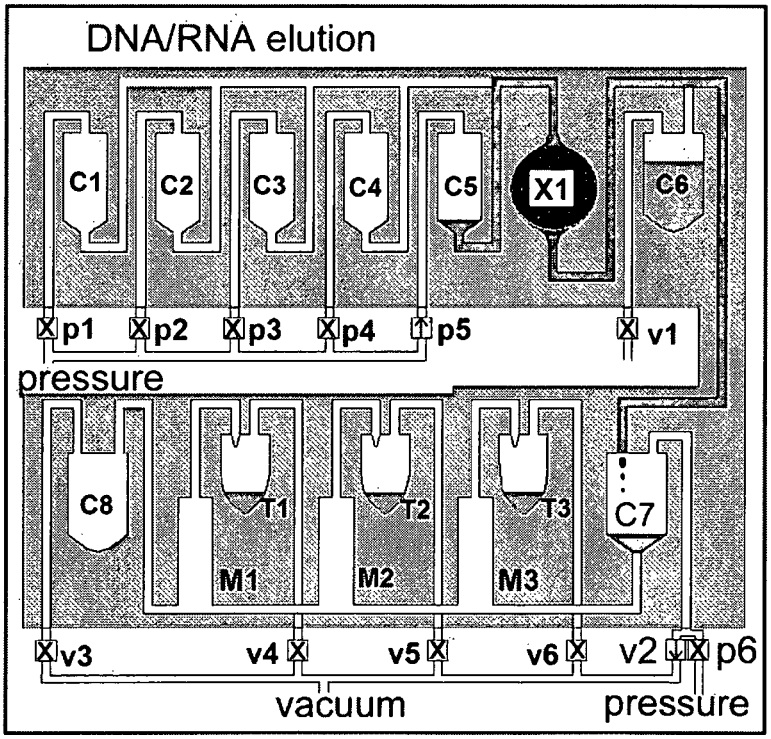

FIG. 3A (cont.)
(III)
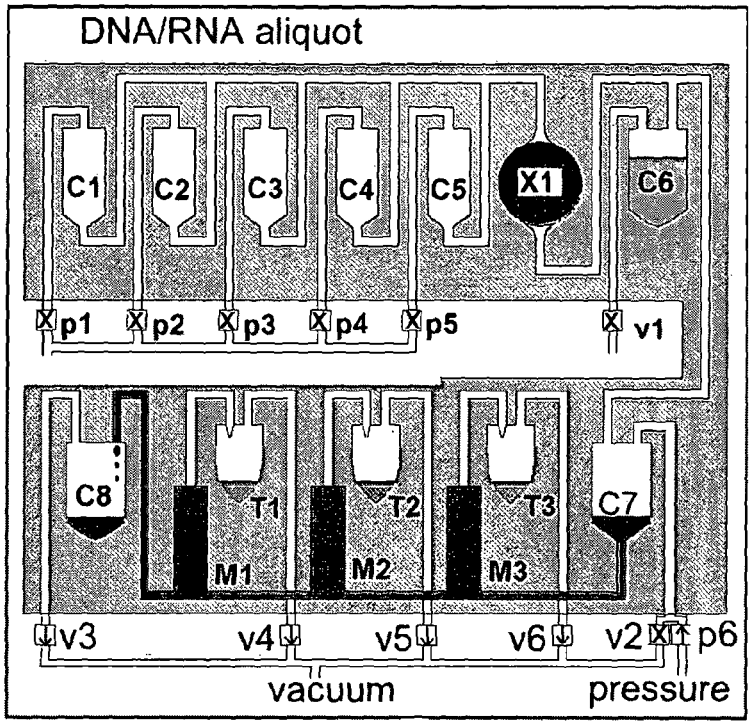
(IV)
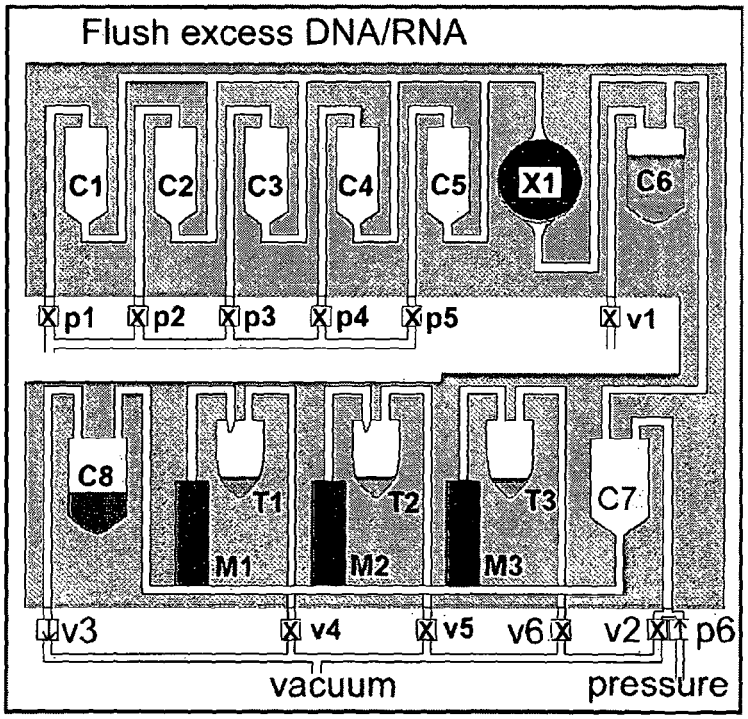

FIG. 3A (cont.)
(V)
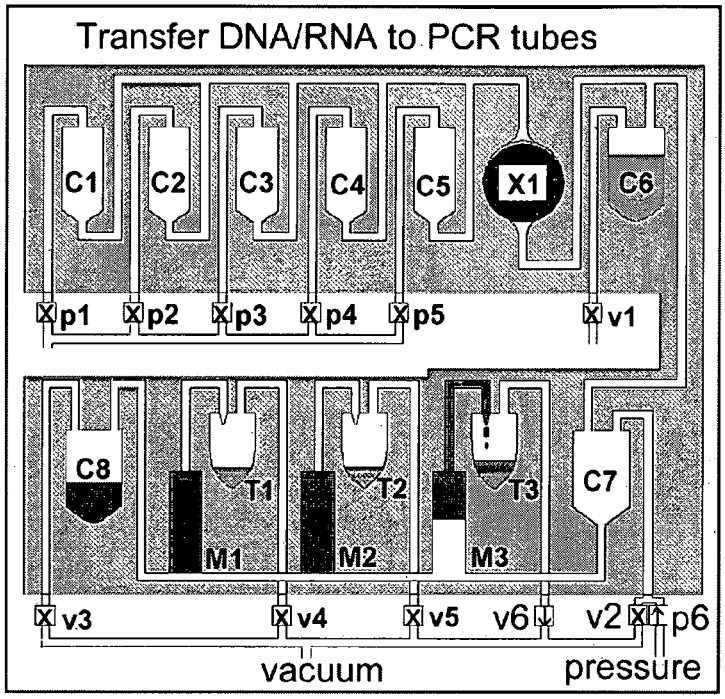
(VI)
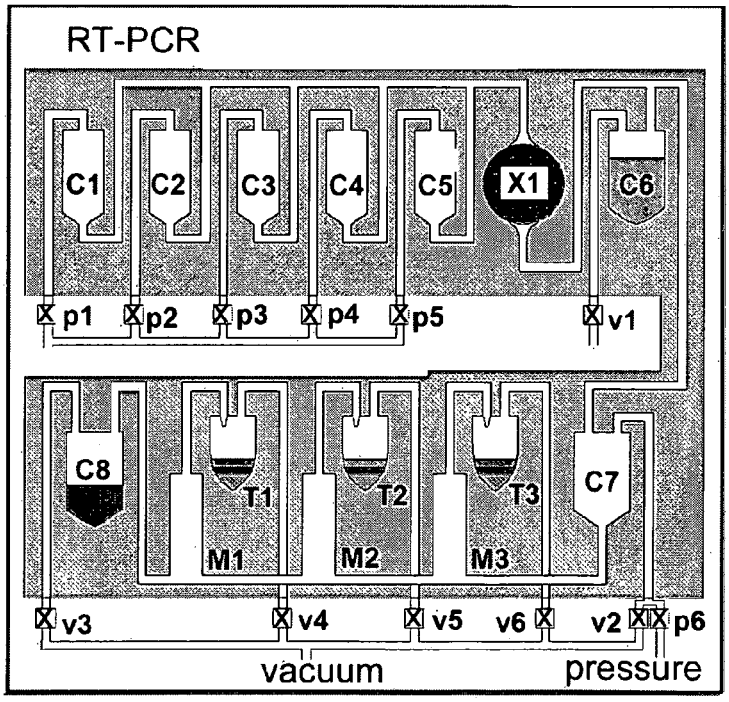

$$\Delta P = 4\sigma\cos(\theta_c)[\frac{1}{R_1} - \frac{1}{R_2}]$$

| Amount of DNA used (ng) | Original DNA | Ct for Spin | Ct for MicroKit |
|---|---|---|---|
| 1000 | 24.73 | 27.11 | 27.87 |
| 100 | 31.03 | 31.8 | 31.23 |
| 10 | 32.32 | 34.06 | 35.11 |
| 1 | 36.25 | 37.97 | 36.61 |
| 0.1 | 38.08 | 39.09 | 38.47 |
| 0.01 | Not Shown | 39.66 | 38.06 |

FIG. 15

Table 1

| Primer/Probe | Sequence (5'–3') | Region (bp) |
|---|---|---|
| *Influenza A* | | |
| Forward | AGATGAGTCTTCTAACCGAGGTCG (SEQ ID NO: 1) | 25–48 |
| Reverse | TGCAAAAACATCTTCAAGTCTCTG (SEQ ID NO: 2) | 101–124 |
| Probe | (FAM)-TCAGGCCCCCTCAAAGCCGA-(TAMRA) (SEQ ID NO: 3) | 64–83 |
| *Seasonal H1N1* | | |
| Forward | AACATGTTACCCAGGGCATTTCGC (SEQ ID NO: 4) | 347–370 |
| Reverse | GTGGTTGGGCCATGAGCTTTCTTT (SEQ ID NO: 5) | 438–461 |
| Probe | (FAM)-GAGGAACTGAGGGAGCAATTGAGTTCAG-(TAMRA) (SEQ ID NO: 6) | 378–405 |

FIG. 16

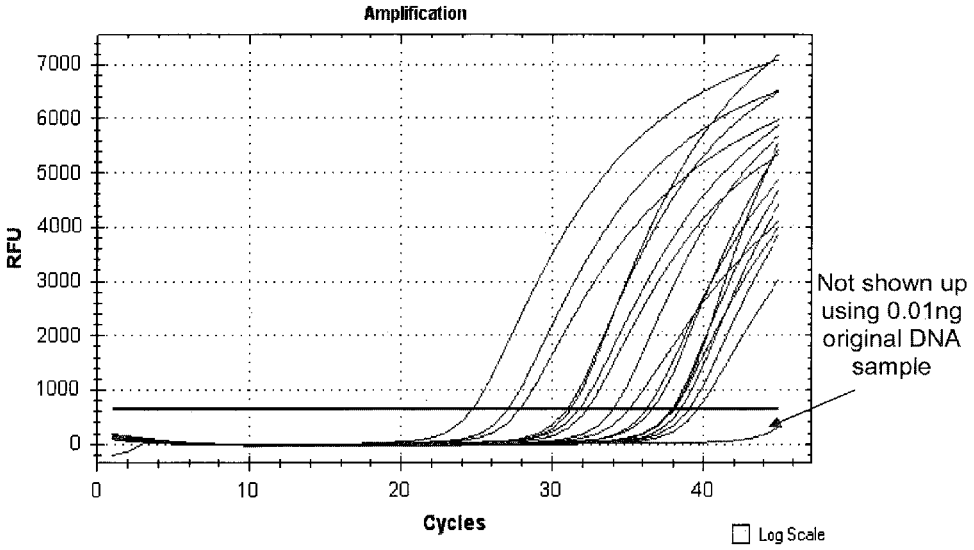

Current RNA Detection limit: 1ng

| Amoung of gene per test (ng) | Original sample Ct | Spin Column Ct | MicroKit Ct |
|---|---|---|---|
| 1000 | 20.65 | 21.75 | 21.21 |
| 100 | 23.32 | 24.82 | 25.41 |
| 10 | 27.80 | 28.35 | 30.69 |
| 1 | 31.25 | 34 | 33.49 |
| 0.1 | 35.95 | Not show | Not show |
| 0.01 | Not show | Not show | Not show |

Current RNA Detection limit: 1ng

FIG. 19B
| Well | Fluor | Content | Sample | Ct(s) |
|---|---|---|---|---|
| A01 | HEX | Unkn | STD10 | 18.79 |
| A02 | HEX | Unkn | 10R10Wax | 20.23 |
| A03 | HEX | Unkn | 10R20Wax | 18.71 |
| A04 | HEX | Unkn | 10R40Wax | 21.28 |
| A05 | HEX | Unkn | STD20R | 18.03 |
| A06 | HEX | Unkn | 20R10Wax | 18.14 |
| A07 | HEX | Unkn | 20R20Wax | 18.45 |
| A08 | HEX | Unkn | 20R40Wax | 19.87 |
FIG. 20A
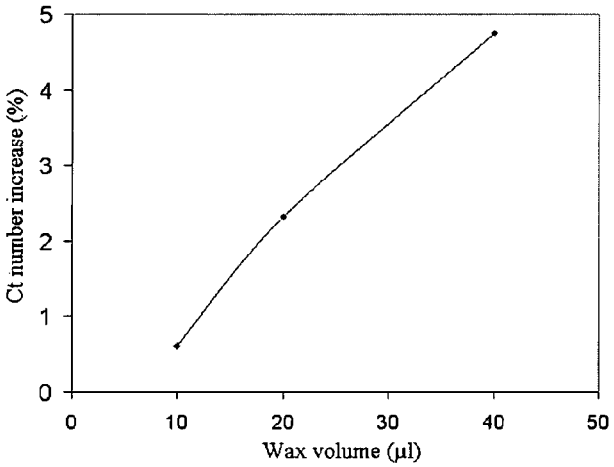
FIG. 20B
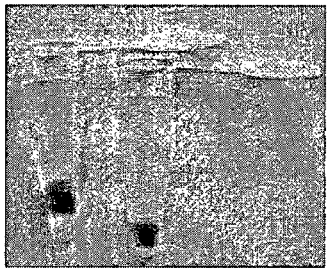
FIG. 21A
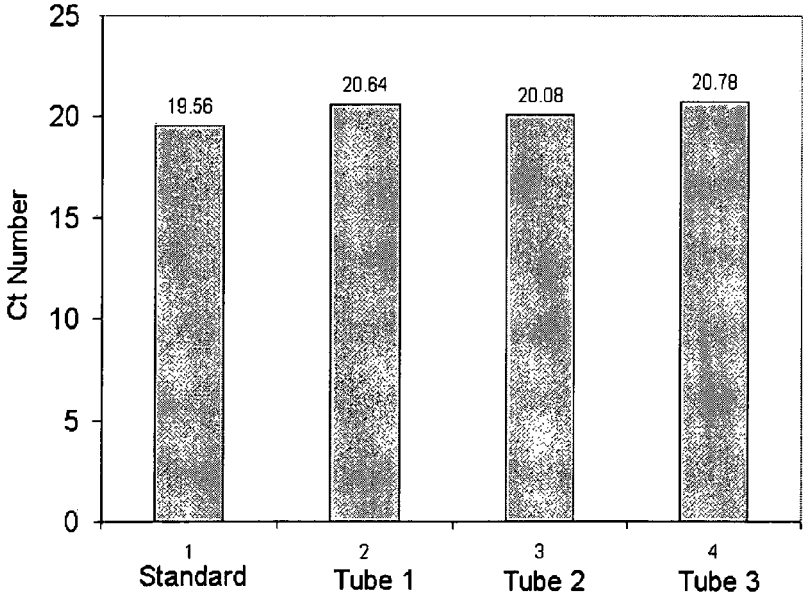

| Total liver RNA Loaded (ng/μl) | Unpurified Liver RNA ($C_T$) | Qiagen Spin Column ($C_T$) | All-in-One Extraction ($C_T$) |
|---|---|---|---|
| 1000 | 18.4 | 19 | 19.5 |
| 100 | 20.9 | 23.2 | 22.5 |
| 10 | 25.3 | 27.2 | 26 |
| 1 | 28.7 | 29 | 30.6 |
| 0.1 | 31.9 | —† | —† |

† RT-PCR failed.

| Influenza A (Dilution Folds) | Qiagen Spin Column and Bio-Rad CFX96 ($C_T$) | All-in-One Extraction and Bio-Rad CFX96 ($C_T$) | All-in-One System ($C_T$) |
|---|---|---|---|
| 1 | 23.03 | 24.70 | 25.74 |
| $10^1$ | 27.23 | 28.57 | 30.26 |
| $10^2$ | 30.14 | 32.40 | 33.03 |
| $10^3$ | 33.96 | 35.20 | 37.68 |
| $10^4$ | 36.49 | 38.24 | —† |

† RT-PCR failed.

REAGENT FLUID DISPENSING DEVICE, AND METHOD OF DISPENSING A REAGENT FLUID

CROSS-REFERENCE TO RELATED APPLICATIONS

This patent application is a U.S. National Phase application under 35 U.S.C. §371 of International Application No. PCT/SG2011/000174, filed May 4, 2011, entitled REAGENT FLUID DISPENSING DEVICE, AND METHOD OF DISPENSING A REAGENT FLUID, which claims the benefit of priority of Singapore patent application No. 201003158-1, filed May 4, 2010, the contents of it being hereby incorporated by reference in its entirety for all purposes.

INCORPORATION BY REFERENCE

This application incorporates by reference the material (i.e., Sequence Listing) in the ASCII text file named P105469_Sequence_Listing_ST25.txt, created on Nov. 1, 2012, having a file size of 2,036 bytes.

FIELD OF THE INVENTION

The present invention refers to a reagent fluid dispensing device, and a method of dispensing a reagent fluid.

BACKGROUND OF THE INVENTION

Conventional methods for diagnosis of diseases such as influenza requires several manual processes, for example, the lysis of virus particles, viral ribonucleic acid (RNA) extraction and detection of the viral nucleic acid, which are often conducted within the confines of centralized laboratories. The entire protocol takes 5 to 6 hours, and requires skilled operators who are at risk of accidental virus exposure and disease contagion.

This is particularly so in the case of highly infectious diseases, for example, H1N1-2009. In less than a month after the first reported case of H1N1-2009 surfaced in Apr. 23, 2009, 39 countries had reported 8480 cases of H1N1-2009 infection and 72 deaths officially to the World Health Organization (WHO).

Current state of the art methods for diagnosis of diseases include nucleic acid-based molecular diagnosis involving three major steps: (i) deoxyribonucleic acid/ribonucleic acid (DNA/RNA) sample preparation, (ii) nucleic acid amplification by polymerase chain reaction (PCR), and (iii) detection of amplified DNA. With its simplicity and effectiveness, real-time PCR (RT-PCR) remains the most popular and robust method for pathogen detection, although detection methods using DNA microchips, label-free approaches and electrophoretic analysis have also been reported.

A number of miniaturized disease diagnostic devices have also been developed. Most of them are focused on either sample preparation for pathogen DNA/RNA purification or on-chip PCR amplification with built-in microvalves, heaters and sensors. Despite these advances, integration of sample purification and molecular detection remains a major challenge for portable disease diagnostic devices. The lack of multiplexing capability has also limited the applicability of these devices towards detecting viruses such as influenza, enterovirus, and the viruses causing hand, foot and mouth disease, such as Coxsackie virus and Enterovirus, which contain various serotypes with similar patient symptoms. In addition, the typical open device design for external introduction of reagents and release of processed waste are prone to hardware cross contamination and accidental virus exposure.

In view of the above, there remains a need for an improved method for the diagnosis of diseases, which can allow the rapid identification of infected patients for isolation and treatment, as well as an apparatus that can be used for diagnosis in decentralized locations such as airports, train stations and immigration check points to contain the spread of highly contagious diseases, and to alleviate the burden of healthcare personnel in the diagnosis of an overwhelming number of suspect cases.

SUMMARY OF THE INVENTION

In a first aspect, various embodiments refer to a reagent fluid dispensing device, comprising

- a chamber for receiving a reagent fluid, the chamber having a first opening and a second opening;
- a first fluid conduit connected to the first opening of the chamber;
- a reservoir connected to the first fluid conduit, the reservoir having a first opening, wherein the first opening of the reservoir is connected to the first fluid conduit to form a passive valve, wherein the reservoir is dimensionalized for storing a predetermined volume of the reagent fluid; and
- a pneumatic conduit connected to the second opening of the chamber, wherein selective application of pneumatic pressure to the chamber through the pneumatic conduit transfers the reagent fluid from the reservoir to the chamber through the first fluid conduit.

In a second aspect, various embodiments refer to a micro-fluid device comprising a reagent fluid dispensing device of the first aspect.

In a third aspect, various embodiments refer to a method of dispensing a reagent fluid, the method comprising

- providing a reagent fluid dispensing device of the first aspect;
- providing a reagent fluid in the reservoir;
- applying pneumatic pressure to the chamber through the pneumatic conduit to transfer the reagent fluid from the reservoir to the chamber through the first fluid conduit.

BRIEF DESCRIPTION OF THE DRAWINGS

Various embodiments will be better understood with reference to the detailed description when considered in conjunction with the non-limiting examples and the accompanying drawings, in which.

pinch valve; v2 refers to a second (vacuum) pinch valve; v3 refers to a third (vacuum) pinch valve; v4 refers to a fourth (vacuum) pinch valve; v5 refers to a fifth (vacuum) pinch valve; v6 refers to a sixth (vacuum) pinch valve; T1 refers to a first PCR chamber (or PCR tube), T2 refers to a second PCR chamber (or PCR tube); T3 refers to a third PCR chamber (or PCR tube); and M1 refers to a first reservoir (or aliquot chamber); M2 refers to a second reservoir (or aliquot chamber); M3 refers to a third reservoir (or aliquot chamber). The status of the pinch valves is denoted using the symbols "X" and arrows (↑ or ↓). A symbol "X" at the pinch valve denotes that the valve is closed, whereas the use of arrows ↑ or ↓ at the pinch valve denotes that the valve is opened. The direction of pressure applied (for first (pressure) pinch valve p1 to sixth (pressure) pinch valve p6) or vacuum applied (for first (vacuum) pinch valve v1 to sixth (vacuum) pinch valve v6) is indicated by the direction of the arrows.

In FIG. 3A(I), a lysed biological sample contained in chamber C1 was loaded into silica membrane chamber X1, and sequentially washed with Wash 1 buffer from chamber C2, Wash 2 buffer from chamber C3 and ethanol from chamber C4. In FIG. 3A(II), purified DNA/RNA eluted with elution buffer from chamber C5 is transferred into eluent chamber C7. In FIG. 3A(III), purified DNA/RNA was dispensed as aliquots with reagent fluid reservoirs (M1 to M3) comprising passive valves. The reagent fluid reservoirs M1 to M3 may be dimensionalized for storing a predetermined volume of the reagent fluid. In FIG. 3A(IV), excess DNA/RNA was flushed to the excess eluent chamber C8. In FIG. 3A(V), extracted RNA was dispensed to PCR chambers (T1 to T3) containing RT-PCR pre-mixture. In FIG. 3A(VI), RT-PCR was carried out. Wax, which was coated on the PCR chambers melts and the liquid wax remains above the RT-PCR mixture and prevents evaporation of the reagent fluid during thermal cycling.

Figure 3B:
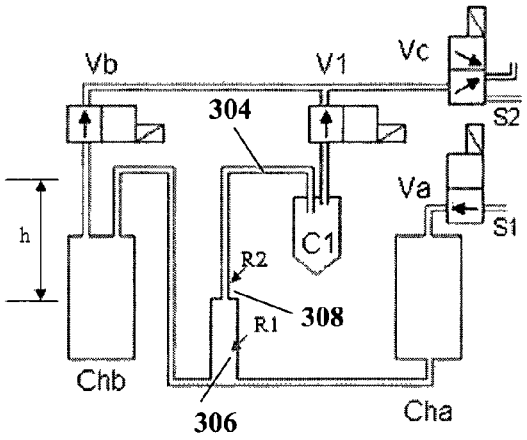
FIG. 3A(I) is a schematic diagram of the operation of the real-time PCR (RT-PCR) system with integrated sample preparation and 3-channel fluorescence detection using an all-in-one cartridge according to an embodiment. The following notations are used in the figure. C1 denotes a sample chamber; C2 denotes a Wash 1 buffer chamber; C3 denotes a Wash 2 buffer chamber; C4 denotes an ethanol chamber; C5 denotes an elution buffer chamber; C6 denotes a waste chamber; C7 denotes an eluent chamber; C8 denotes an excess eluent chamber; X1 denotes a silica membrane chamber; p1 refers to a first (pressure) pinch valve; p2 refers to a second (pressure) pinch valve; p3 refers to a third (pressure) pinch valve; p4 refers to a fourth (pressure) pinch valve; p5 refers to a fifth (pressure) pinch valve; p6 refers to a sixth (pressure) pinch valve; v1 refers to a first (vacuum)

FIG. 3B is a schematic diagram of a reagent fluid dispensing device according to an embodiment. The pressure change over the passive valve can be determined using formula (I)

$$\Delta P = 4\sigma\cos(\theta_c)\left[\frac{1}{R_1} - \frac{1}{R_2}\right] \quad \text{(I)}$$

wherein ΔP denotes pressure required to push the reagent liquid across the passive valve; σ denotes the surface tension of the liquid/air interface; $\theta_c$ denotes the contact angle; $R_1$ denotes the radius of the reservoir 306; $R_2$ denotes the radius of the passive valve 308 or the first fluid conduit 304.

Figure 3C:
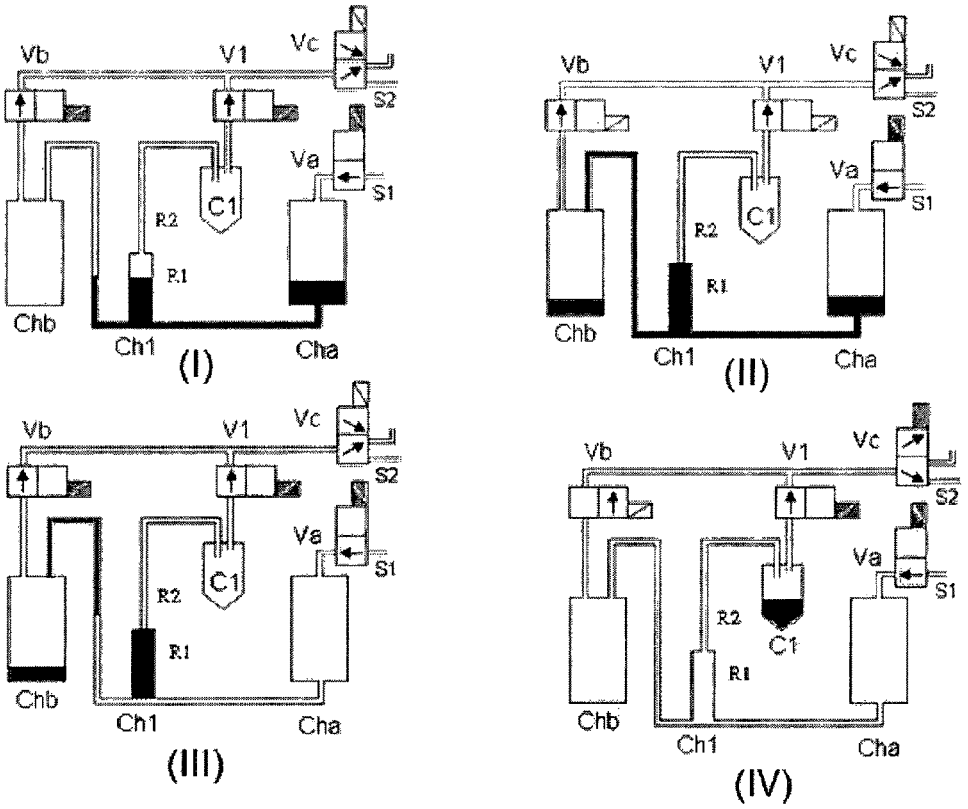

FIG. 3C(I) to FIG. 3C(IV) are schematic diagrams showing the operation of a reagent fluid dispensing device according to an embodiment.

Figure 3D:
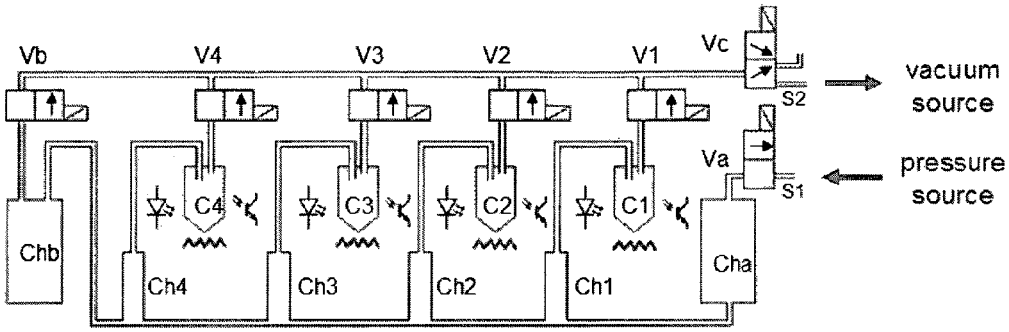

FIG. 3D is a schematic diagram of a reagent fluid dispensing device having four reservoirs Ch1 to Ch4 according to an embodiment.

Figure 4A:
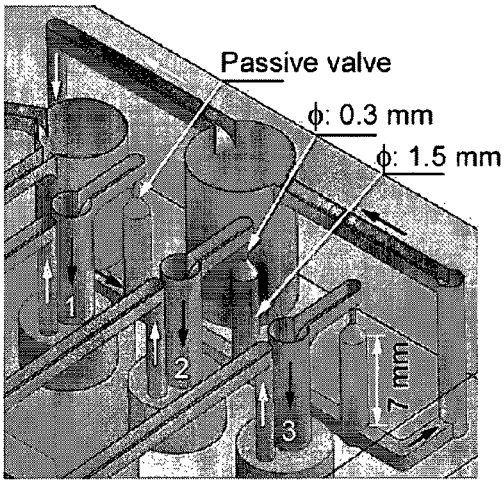

FIG. 4A is a 3D model of a reagent fluid reagent dispensing device using passive valves according to an embodiment. The black arrows represent reagent flow, while white arrows represent negative pressure applied.

Figure 4B:
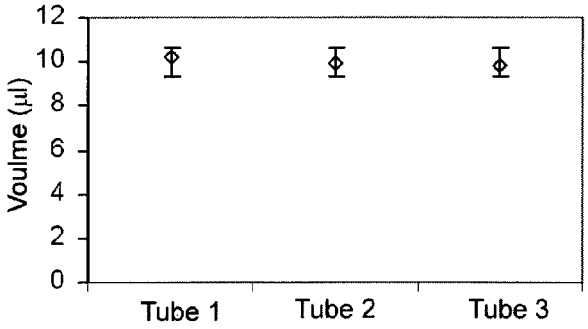

FIG. 4B is a graph depicting accuracy of fluid aliquots dispensed across the three aliquot reservoirs with a target volume of 10 μl. ◇ denotes average volume of 16 repeated measurements with water. Error bar used in the graph has a value of 3 standard deviations.

Figure 5A:
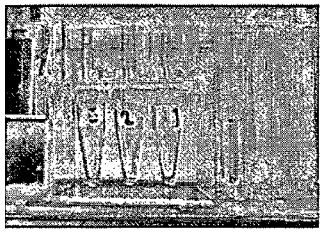
Figure 5B:
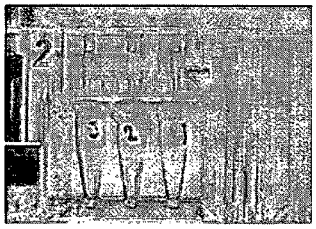
Figure 5C:
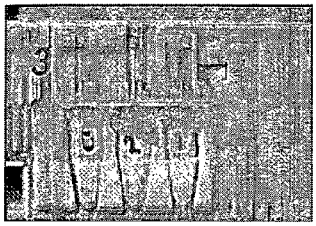
Figure 5D:
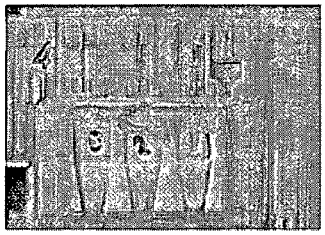
Figure 5E:
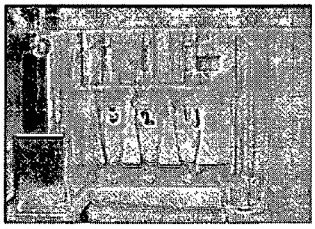
Figure 5F:
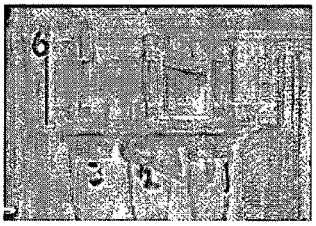
Figure 5G:
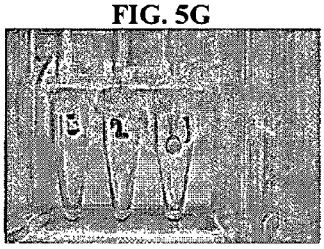
Figure 5H:
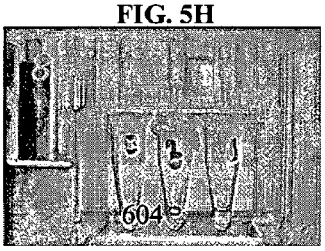
Figure 5I:
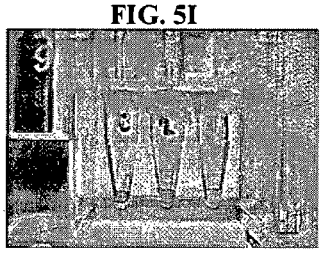

FIG. 5A to FIG. 5I are time sequence photographs of aliquot dispensing of RNA eluent using a reagent fluid dispensing device according to an embodiment. The RNA eluent is coloured with blue food dye. In FIG. 5A, the eluent has passed through the silica membrane in X1 and is being transferred to the eluent chamber C7. In FIG. 5B, the eluent begins to fill up the eluent chamber C7. In FIG. 5C to FIG. 5E, reservoirs M1 to M3 are sequentially filled up to the constriction of the reservoirs. In FIG. 5F, excess eluent is directed to the excess eluent chamber C8 and the connection line to the reservoirs is flushed. In FIG. 5G to FIG. 5I, the fluid within each aliquot reservoir is isolated, and precise volumes of the eluent is dispensed into the respective PCR chambers T1 to T3 (indicated as 1 to 3 in the figure).

Figure 6:
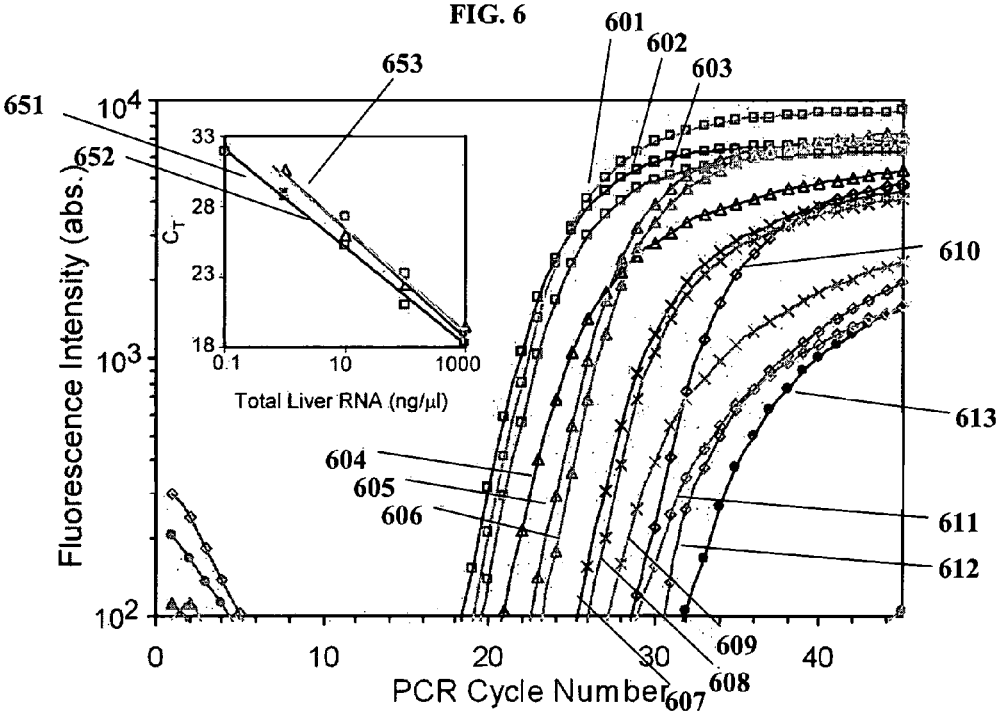

FIG. 6 is a graph showing the real-time fluorescence curves of serial diluted (1 to $10^4$ folds or 1000 to 0.1 ng/μl) total liver RNA: extracted using (—) the all-in-one cartridge (603, 605, 608 and 612), (—) the Qiagen spin column (601, 606, 609 and 611), and (—) unpurified sample, and reverse transcripted amplified using Bio-Rad CFX-96 (602, 604, 607, 610 and 613) (□=1000 ng/μl, Δ=100 ng/μl, x=10 ng/μl, ◇=1 ng/μl; ●=0.1 ng/μl). The inset showed the $C_T$ values of the fluorescence curves. The solid lines were the linear regression fits for (—) the all-in-one cartridge (slope=−3.68, E=87%, $R^2$=0.990) (653), (—) the Qiagen spin column (slope=−3.40, E=97%, $R^2$=0.972) (652), and (—) unpurified sample (slope=−3.48, E=94%, $R^2$=0.994) (651), where $E=10^{(-1/slope)}-1$ was the RT-PCR efficiency. The fluorescence signals in the initial cycles (≤10 PCR cycle number) were due to trapped bubbles.

Figure 7A:
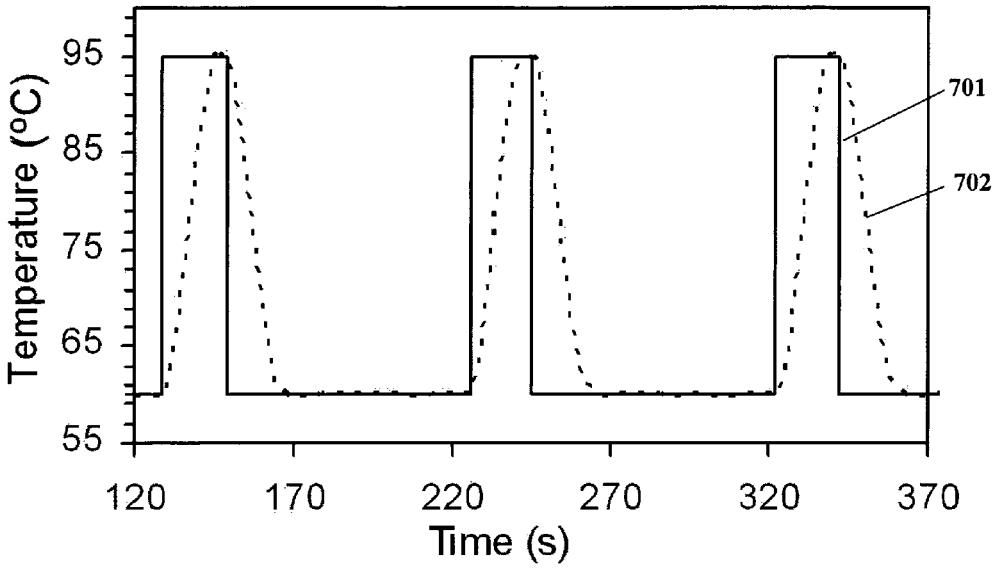

FIG. 7A is a graph showing the thermal cycling profiles of the PCR thermal cycler according to an embodiment: (—) set temperature (701) and (- - -) measured temperature (702). The heating and cooling rates estimated from this figure were 2.5° C./s and 2.2° C./s, respectively.

Figure 7B:
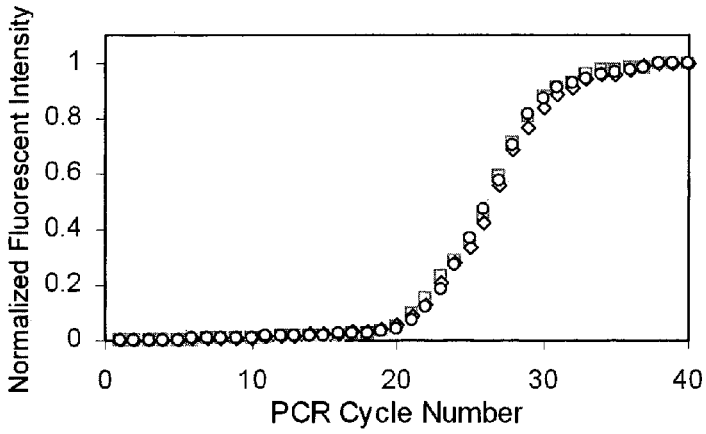

FIG. 7B shows the real-time PCR curves of the (○) left, (◇) center and (□) right PCR tubes, conducted with 10-fold diluted GAPDH cDNA mixture. The normalized fluorescence intensities were highly consistent across the three PCR tubes.

Figure 8:
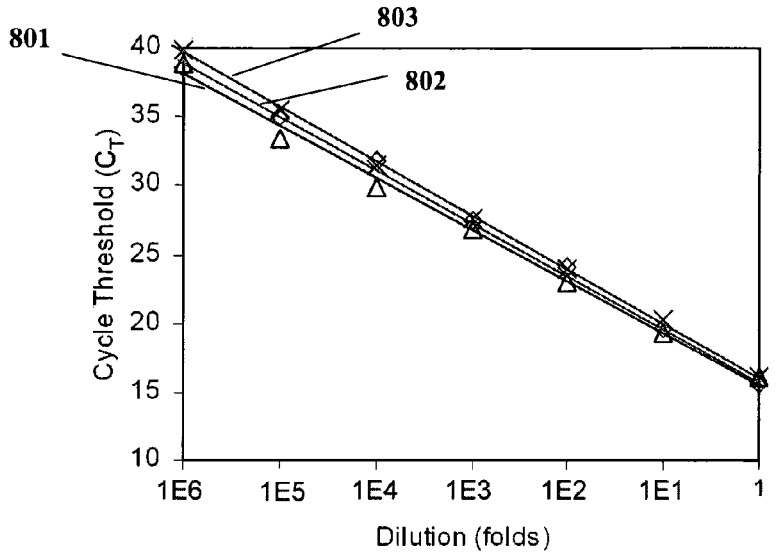

FIG. 8 is a graph showing the cycle threshold ($C_T$) values of serial diluted (1 to $10^6$ folds) GAPDH cDNA, amplified and measured with (x) the thermal cycler and detection system according to an embodiment, (◇) the MJ Research Opticon system, and (Δ) the Bio-Rad CFX96 system. The solid lines are the linear regression fits for (—) the all-in-one cartridge (slope=−3.89, E=81%, $R^2$=0.999) (803), (—) the MJ Research Opticon system (slope=−3.84, E=82%, $R^2$=0.998) (802), and (—) the Bio-Rad CFX96 system (slope=−3.71, E=86%, $R^2$=0.994) (801), where $E=10^{(-1/slope)}-1$ was the RT-PCR efficiency.

Figure 9A:
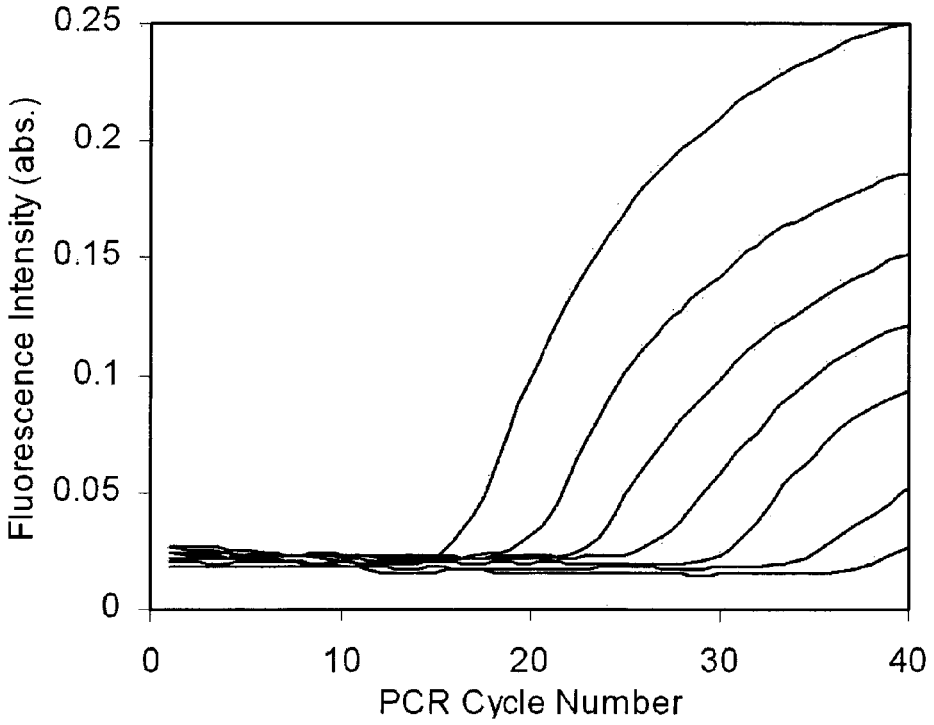
Figure 9B:
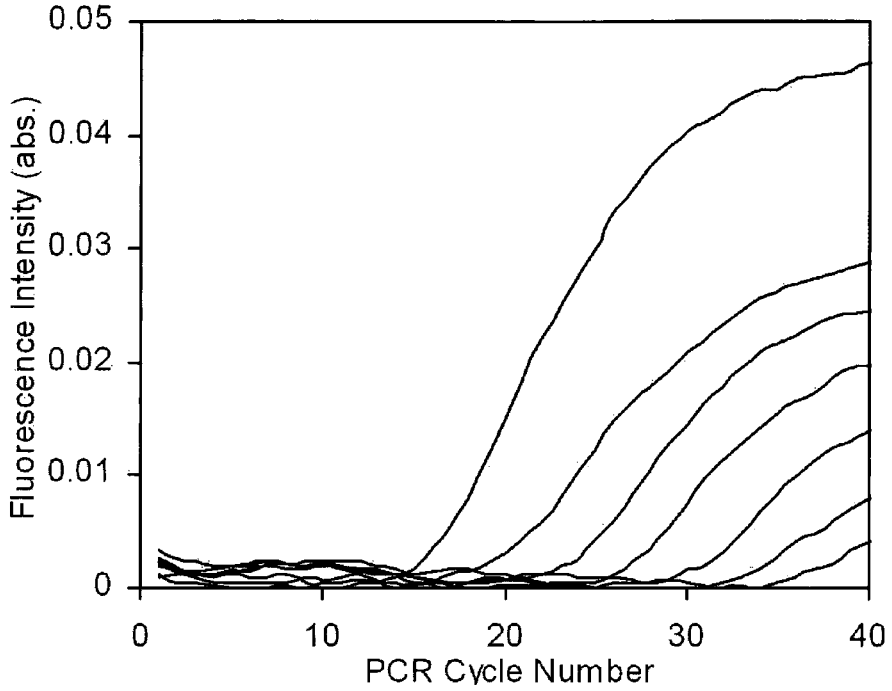
Figure 9C:
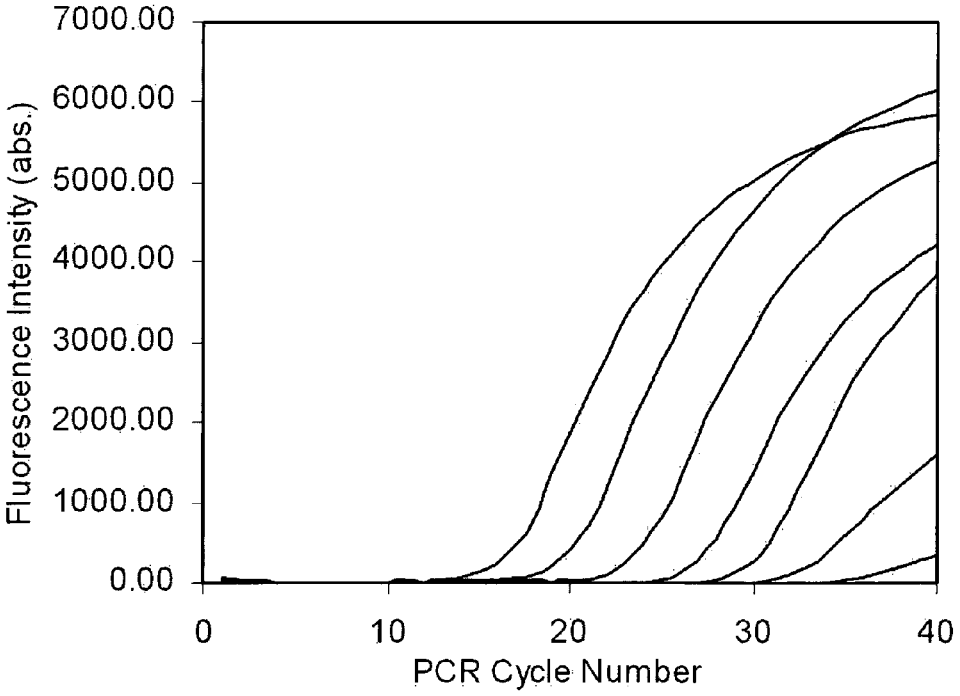

FIG. 9A to FIG. 9C are graphs comparing the performance of on-cartridge real-time PCR, in which the real-time fluorescence curves of serial diluted (1 to $10^6$ folds) glyceraldehyde 3-phosphate dehydrogenase (GAPDH) cDNA are amplified and measured with the thermal cycler according to an embodiment shown in FIG. 9A; the MJ Research Opticon system shown in FIG. 9B; and the Bio-Rad CFX96 system shown in FIG. 9C.

The thermal cycler according to an embodiment utilized light emitting diodes (LEDs) as light source and a photomultiplier tube (PMT) for detection. The MJ Research Opticon employed LEDs plus PMTs, and the Bio-Rad CFX96 used LEDs and photodiodes.

Figure 10:
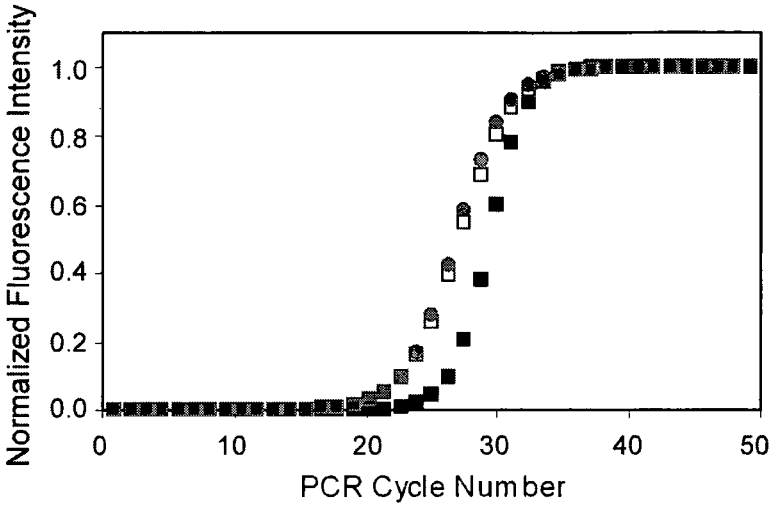

FIG. 10 is a graph showing the real-time RT-PCR fluorescence curves of seasonal influenza H1N1 virus detected by all-in-one cartridge with sub-typing classifications: (●) type A ($C_T$=24.23), (■) sub-type H1 ($C_T$=27.45), and (□) positive control ($C_T$=24.38). Positive control was conducted with RNA of the same patient sample that was extracted by Qiagen Spin Column. $C_T$ values were obtained at a normalized threshold value of 0.2.

Figure 11:
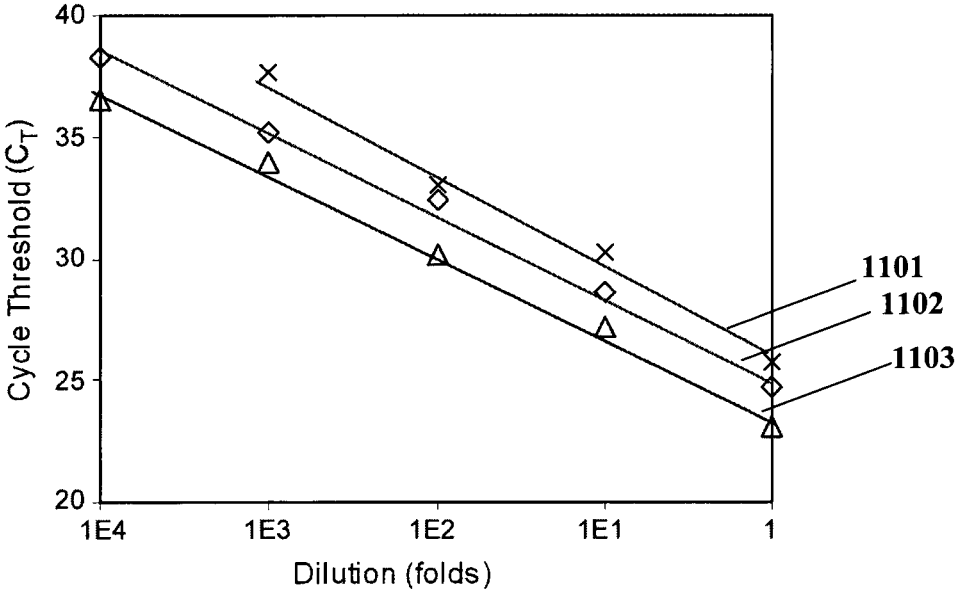

FIG. 11 is a graph showing the $C_T$ values of the real-time fluorescence curves of serial diluted (1 to $10^4$ folds) influenza A patient samples, obtained with (Δ) the Qiagen Spin Column plus Bio-Rad CFX96, (◇) the on-cartridge RNA extraction plus Bio-Rad CFX96, and (x) the all-in-one system. The solid lines are the linear regression fits obtained for (—) Qiagen Spin Column with Bio-Rad CFX96 (slope=−3.37, E=99%, $R^2$=0.994) (1103), (—) the on-cartridge RNA extraction with Bio-Rad CFX96 (slope=−3.37, E=99%, $R^2$=0.995) (1102), and (—) the all-in-one system (slope=−3.59, E=90%, $R^2$=0.991) (1101), where $E=10^{(-1/slope)}-1$ was the RT-PCR efficiency.

Figures 12, 13A:
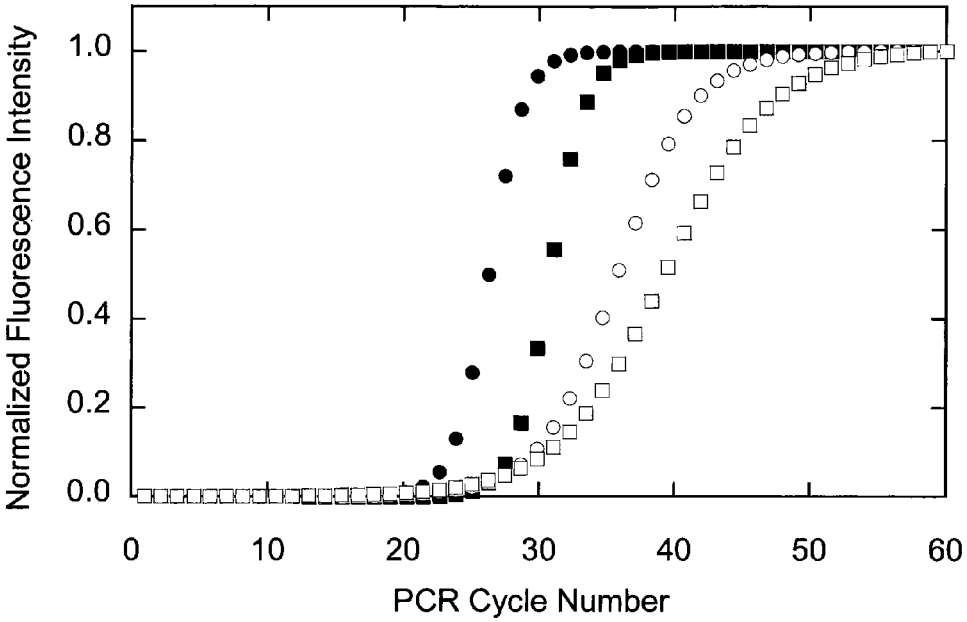

FIG. 12 is a graph showing on-cartridge real-time PCR. The real-time fluorescence curves of serial diluted ((●) O-fold, (■) 10-fold, (○) $10^2$-fold and (□) $10^3$-fold) influenza A, amplified and measured with the thermal cycler and detection system according to an embodiment.

FIG. 13A is a table showing the PCR results for DNA extraction.

Figure 13B:
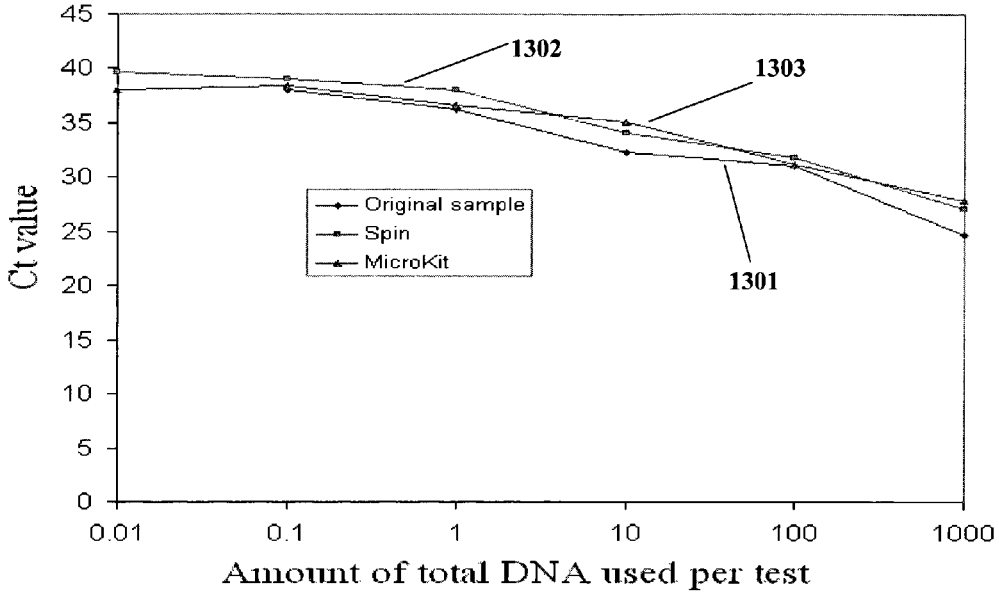

FIG. 13B is a graph comparing the PCR results for DNA extraction with values shown in FIG. 13A. 1301 is the curve for original unpurified DNA sample; 1302 is the curve for Qiagen Spin Column with Bio-Rad CFX96 and 1303 is the curve for microkit according to an embodiment.

Figure 14A:
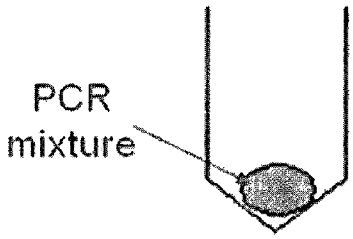
Figure 14B:
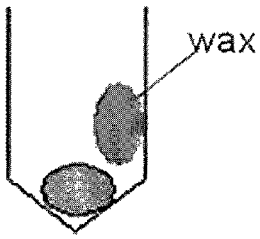
Figure 14C:
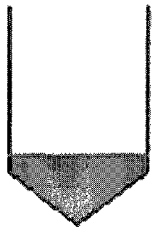
Figure 14D:
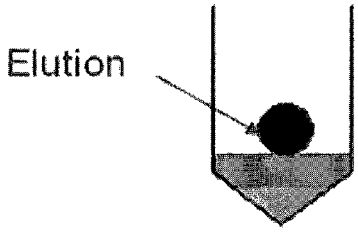
Figure 14E:
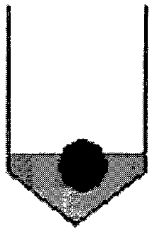
Figure 14F:
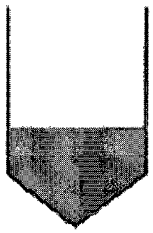

FIG. 14A to FIG. 14F are schematic diagrams depicting the steps for the slow dispersal of mixtures in a PCR chamber according to an embodiment. FIG. 14A shows addition of a 20 μl PCR pre-mixture in a PCR chamber. FIG. 14B shows addition of wax to a side wall of the PCR chamber. FIG. 14C shows melting of the wax to form a seal on the PCR solution. FIG. 14D shows addition of an elution buffer. FIG. 14E depicts slow movement of the elution buffer through the wax layer to the PCR volume. FIG. 14F shows mixing of the PCR pre-mixture with the elution buffer under the wax seal.

FIG. 15 is a table showing PCR primer and hydrolysis probe sequence.

FIG. 16 is a graph showing PCR curves for DNA extraction.

Figures 17A, 17B:
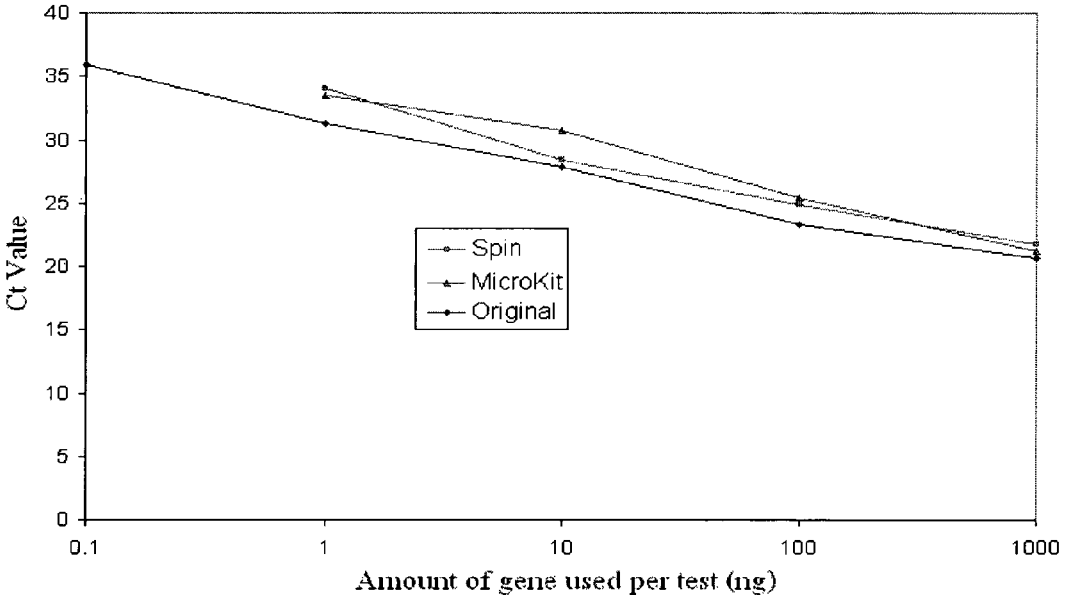

FIG. 17A is a table summarizing the PCR results for RNA extraction. FIG. 17B is a graph summarizing the PCR results for RNA extraction. Values in the table are $C_T$ values for original sample, sample from spin column and Microkit.

Figure 18:
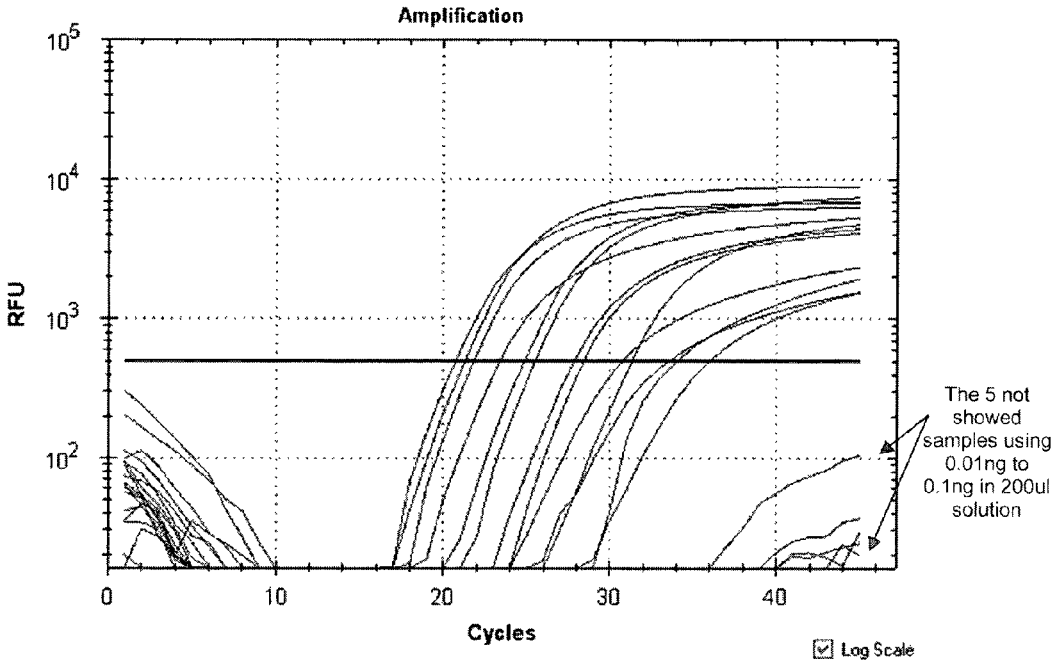

FIG. 18 is a graph showing PCR curves for RNA extraction.

Figure 19A:
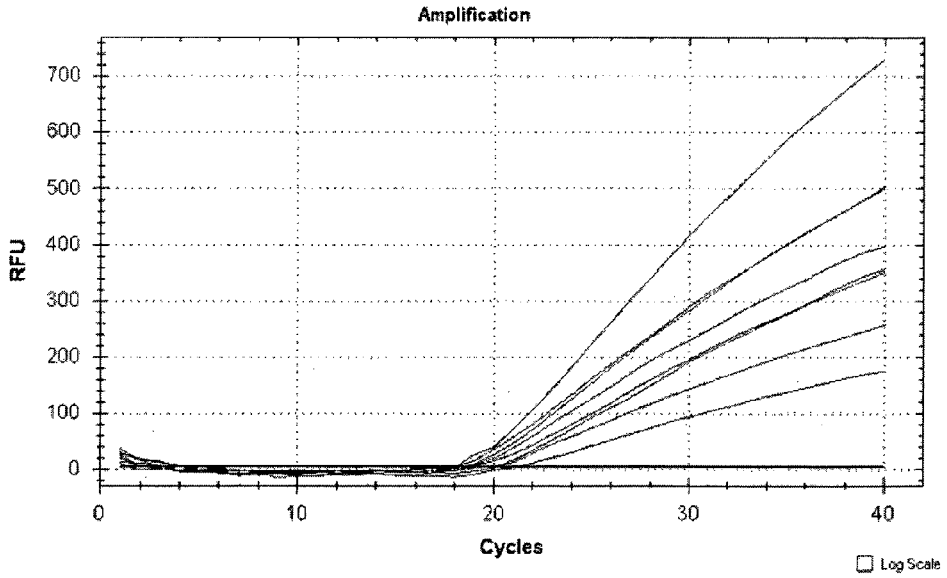

FIG. 19A is a graph showing PCR curve and FIG. 19B is a table showing $C_T$ values for 10 μl (A01 to A04) and 20 μl (A05 to A08) of PCR reaction volume using 10 μl (A02 and A06), 20 μl (A03 and A07) and 40 μl (A04 and A08) of wax for sealing. A01 and A05 are $C_T$ values obtained using standard reaction tubes.

FIG. 20A is a graph showing the effects of wax volume on PCR.

FIG. 20B is a photograph showing 10 μl and 20 μl of wax in the PCR tubes.

FIG. 21A is a graph comparing between the $C_T$ values using 20 μl of wax and standard.

Figures 21B, 22, 23:
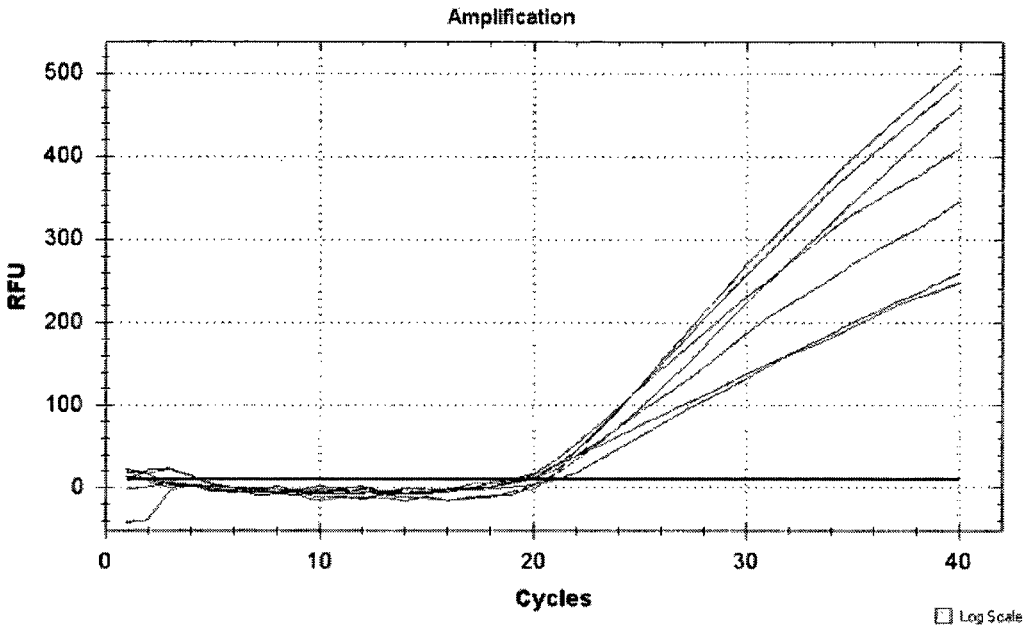

FIG. 21B is a graph showing PCR curves for using 20 μl of wax sealing prior to addition of elute and PCR.

FIG. 22 is a table showing $C_T$ values of real-time RT-PCR of 0.1 ng/μl to 1000 ng/μl RNA extracted by the all-in-one system vs. the Qiagen spin column, and the original unpurified sample.

FIG. 23 is a table for comparison CT values of the real-time fluorescence curves of serial diluted (1 to $10^4$-fold) influenza A patient samples extracted and detection by: 1) the Qiagen Spin Column for virus sample extraction and using Bio-Rad CFX96 for PCR amplification, 2) the All-in-One System for virus extraction and using Bio-Rad CFX96 for PCR amplification, and 3) the All-in-One System for both virus extraction and amplification.

DETAILED DESCRIPTION OF THE PRESENT INVENTION

In a first aspect, various embodiments refer to a reagent fluid dispensing device. The term "dispensing" as used herein refers to the process of distributing or administering a material. Generally, any type of reagent fluids, such as a liquid or a suspension, can be dispensed using the device. In some embodiments, the reagent fluid is a liquid containing a sample for analysis.

The reagent fluid dispensing device includes a chamber for receiving a reagent fluid. The chamber may be of any shape, such as a cylinder, a cone, a sphere or irregularly shaped. In some embodiments, the chamber has a substantially cylindrical body with a tapered base. In some embodiments, the chamber has a substantially cylindrical body with a flat base. The chamber may be made of any material, for example, a metal, ceramic, silicon, glass, or a polymer, such as polycarbonate (PC) or polymethyl methacrylate (PMMA). The chamber may be of any size, which may in turn be dependent on the type of application. Generally, the chamber has sufficient volumes for performing the required process or treatment. For example, in case of biological applications, the sample amount is typically small, therefore the chamber may have a volume in the order of micro-liters. In some other applications such as chemical analysis, the sample amount may be greater, therefore the chamber may have a volume in the order of milliliters. The volume of the chamber may be about 1 micro liter to about 100 milliliter, such as about 1 micro liter to about 10 milliliter about 1 micro liter to about 1 milliliter, or about 1 micro liter to about 50 micro liter.

The chamber for receiving a reagent fluid according to the present invention has a first opening and a second opening. The size of the first opening and the second opening may depend on the sample amount and the size of the chamber. The first opening and the second opening may be of any shape, such as a circle, an oval or a rectangle. Typically, the first opening and the second opening of the chamber are circular holes. The first opening and the second opening of the chamber may have a maximal dimension in the range of about 0.2 mm to about 1 mm, such as about 0.2 mm to about 0.6 mm, or about 0.4 mm to about 0.8 mm. At least one of the first opening and the second opening of the chamber may be at a level that is higher than a liquid level in the chamber.

A first fluid conduit may be connected to the first opening of the chamber. As used herein, the term "fluid conduit" refers to a pipe, canal, tube, channel or passage for conveying fluid. The first fluid conduit may be substantially cylindrical. Fluid conduits of other cross-sectional shapes, such as an oval or a rectangle, may also be used. Typically, the first fluid conduit is a short length of cylindrical tube. The length of the cylindrical tube may be in the range of about 5 mm to about 100 mm.

The first fluid conduit may be connected to the first opening of the chamber in such a way that the first fluid conduit and the chamber are tightly sealed and form closed conduits for allowing fluid communication between the first fluid conduit and the chamber. In some embodiments, one end of the first fluid conduit may be attached to the first opening of the chamber by welding or glue bonding. For example, the first fluid conduit may be smaller than the first opening of the chamber, such that the first fluid conduit may extend into the first opening of the chamber. The chamber may be connected to the first fluid conduit by welding or glue bonding to the external wall of the fluid conduit. In some embodiments, the chamber may be removably attached to the first fluid conduit. For example, both the first fluid conduit and the first opening of the chamber have screw threads such that the chamber may be removably attached to the first fluid conduit via the screw threads. In some embodiments, the chamber and the first fluid conduit may be integrally formed. For example, both the chamber and the first fluid conduit may be fabricated using a suitable polymer such as polycarbonate, and may be integrally formed by injection molding.

The reagent fluid dispensing device according to the present invention includes a reservoir. The term "reservoir" as used herein refers to a receptacle or chamber for containing a fluid. The reservoir may be of any shape, such as a cylinder, a cone, a sphere or a irregularly shaped chamber. In some embodiments, the reservoir is at least substantially cylindrical in shape. The reservoir can be made of any suitable material such as that mentioned herein for forming the chamber.

The reservoir may have a first opening for connecting to the first fluid conduit via the opening. The reservoir may be attached to the first fluid conduit such that the first fluid conduit and the reservoir are tightly sealed and form closed conduits for allowing fluid communication between the reservoir to the chamber via the first fluid conduit. In some embodiments, the first fluid conduit is attached to the first opening of the reservoir by welding or glue bonding. In some embodiments, the first fluid conduit and the reservoir are integrally formed by injection molding.

The reservoir may be dimensionalized for storing a predetermined volume of the reagent fluid for dispensing into the chamber. This predetermined volume may be specified by the user and may be dependent on the type of application. Generally, the volume of the reservoir is about 1 micro liter to about 50 micro liter, such as about 1 micro liter to about 30 micro liter, about 1 micro liter to about 10 milliliter, or about 10 micro liter.

The reagent fluid dispensing device according to the present invention includes a pneumatic conduit. The term "pneumatic conduit" refers to a pipe, canal, tube, channel or passage for conveying pressure or vacuum. The pneumatic conduit may be connected to the second opening of the chamber and selective application of pneumatic pressure to the chamber through the pneumatic conduit may transfer the reagent fluid from the reservoir to the chamber through the first fluid conduit.

As mentioned herein, the first opening of the chamber may be attached to the first fluid conduit, which may in turn be attached to the reservoir. In some embodiments, the pneumatic pressure applied to the chamber through the pneumatic conduit is negative, for example a vacuum. The vacuum may be generated using a vacuum pump that is connected to the pneumatic conduit. As the chamber, the first fluid conduit and the reservoir are tightly sealed to form closed conduits for fluid communication between the reservoir to the chamber via the first fluid conduit, application of a vacuum to the chamber through the pneumatic conduit may transfer the reagent fluid from the reservoir through the first fluid conduit into the chamber.

In some embodiments, a passive valve may be formed from the connection between the reservoir and the first fluid conduit. The term "passive valve" as used herein refers a static valve that has no moving parts and which acts as a fluid valve due primarily to its geometric configuration. The use of such passive valves is advantageous as they require no moving parts or an additional control circuitry to open or close the valves. The passive valve of the present invention is based on the use of pneumatic pressure to overcome capillary forces which may prevent liquids from flowing between regions of a fluid conduit having different cross-sectional areas. For example, liquids which completely or partially wet internal surfaces of the fluid conduits that contain them experience a resistance to flow when moving from a fluid conduit of a smaller cross section to one of a larger cross section. Conversely, liquids that do not wet these surfaces resist flowing from a fluid conduit of a larger cross section to one of a smaller cross section. The magnitude of the capillary pressure may depend on the size of the fluid conduits, the surface tension of the fluid, and the contact angle of the fluid on the material of the fluid conduits.

The passive valve of the present invention may have a cross-sectional area that is the same as or smaller than the cross-sectional area of the first fluid conduit. In embodiments in which the passive valve has a smaller cross-sectional area than the first fluid conduit, the ratio of the cross-sectional area of the passive valve to the cross-sectional area of the first fluid conduit may be between about 1:1 to about 1:2500, such as between about 1:1 to about 1:2000, between about 1:1 to about 1:1000, between about 1:1 to about 1:500, between about 1:1 to about 1:100, between about 1:500 to about 1:2500, between about 1:1000 to about 1:2500, or between about 1:500 to about 1:1500.

The reservoir may have a cross-sectional area that is greater than the cross-sectional area of the passive valve. The ratio of the cross-sectional area of the passive valve to the cross-sectional area of the reservoir may be in the range of about 1:4 to about 1:4000, such as between about 1:4 to about 1:3000, between about 1:4 to about 1:2000, between about 1:4 to about 1:1000, between about 1:4 to about 1:500, between about 1:100 to about 1:4000, between about 1:500 to about 1:4000, between about 1:1000 to about 1:4000, or between about 1:500 to about 1:2000.

In some embodiments, the reservoir has a second opening. In some embodiments, the second opening is located at the base of the reservoir. In some embodiments, the second opening corresponds to the base of the reservoir. In other words, the second opening may have a size that is as large as the base of the reservoir. A second fluid conduit may be connected to the second opening of the reservoir. The second fluid conduit may be substantially cylindrical. Fluid conduits of other cross-sectional shapes, such as an oval or a rectangle, may also be used Generally, the second fluid conduit is a cylindrical tube. The cross-sectional area of the second fluid conduit may be of any value, such as between about 0.001 $mm^2$ to about 10 $mm^2$, between about 0.01 $mm^2$ to about 10 $mm^2$, between about 0.1 $mm^2$ to about 10 $mm^2$, between about 1 $mm^2$ to about 10 $mm^2$, between about 0.001 $mm^2$ to about 1 $mm^2$, between about 0.001 $mm^2$ to about 0.1 $mm^2$ or between about 0.01 $mm^2$ to about 1 $mm^2$.

The second fluid conduit may be connected to the second opening of the reservoir such that the second fluid conduit and the reservoir are tightly sealed to form closed conduits for fluid communication between the second fluid conduit and the reservoir. The second fluid conduit may be attached to the first opening of the reservoir by welding or glue bonding. In some embodiments, the second fluid conduit may be integrally formed with the reservoir via injection molding or precision injection molding.

The direction of flow of the reagent fluid in the second fluid conduit may be substantially perpendicular to the direction of flow of the reagent fluid in the reservoir. For example, the base of the reservoir may be connected to the second fluid conduit via a side wall of the second fluid conduit. In some embodiments, the reservoir and the second fluid conduit are placed such that the reagent fluid flows from the second fluid conduit to the reservoir in an or partially in an upward direction against gravity. When a reagent fluid flows through the second fluid conduit, pneumatic pressure in the form of a vacuum that is applied to the chamber through the pneumatic conduit may transfer the reagent fluid into the reservoir, such that the reservoir is substantially filled with the reagent fluid. In some embodiments, the reservoir is allowed to fill to the level of the passive valve. Pneumatic pressure may also be applied to the reagent fluid through the second fluid conduit to transfer the reagent fluid into the reservoir. A pump such as a centrifugal pump or a positive displacement pump may be used to provide pneumatic pressure to the reagent fluid.

In some embodiments, pneumatic pressure is applied to the reagent fluid through the second fluid conduit so as to transfer the reagent fluid from the reservoir to the chamber through the first fluid conduit. The resultant of the pneumatic pressure to the chamber through the pneumatic conduit and the pneumatic pressure to the reagent fluid through the second fluid conduit may be greater than the pressure required to transfer the reagent fluid through the passive valve. In this way, the reagent fluid may be transferred into the chamber from the reservoir by passing through the passive valve and the first fluid conduit.

In some embodiments, the reservoir and the first fluid conduit are placed such that reagent fluid flows from the reservoir to the first fluid conduit in an or partially in an upward direction against gravity. The resultant of the pneumatic pressure to the chamber through the pneumatic conduit and the pneumatic pressure to the reagent fluid through the second fluid conduit may be greater than the pressure required to transfer the reagent fluid through the passive valve in an or partially in an upward direction against gravity.

In embodiments where the reservoir is dimensionalized for storing a predetermined volume of the reagent fluid for dispensing into the chamber, as substantially all of the reagent fluid in the reservoir may be dispensed into the chamber, therefore the precise amount of reagent fluid that is administered into the chamber may also be predetermined.

Typically, the resultant of the pneumatic pressure to the chamber through the pneumatic conduit and the pneumatic pressure to the reagent fluid through the second fluid conduit is between about 0.1 KPa to about 10 KPa, such as between about 0.1 KPa to about 1 KPa, between about 0.1 KPa to about 0.5 KPa, between about 0.5 KPa to about 10 KPa, between about 1 KPa to about 10 KPa, or between about between about 5 KPa to about 10 KPa.

In some embodiments, a plurality of reservoirs may be present in the reagent fluid dispensing device. The number of reservoirs may be of any number, such as two, three, four, or five, depending on the requirements of the user. Each reservoir may be of the same size and/or shape. In some embodiments, each reservoir may have a different size and/or shape which can be specified according to the requirements of the user. For example, each reservoir may have a different predetermined volume for dispensing a different amount of reagent fluids. Each reservoir may be connected to an independent first fluid conduit, which may in turn be connected to an independent chamber and pneumatic conduit, so that the reservoir, first fluid conduit, chamber and pneumatic conduit assembly may be operated and/or controlled independently. In some embodiments, each fluid conduit, chamber and pneumatic conduit may have a different size and/or shape which can be specified according to the requirements of the user. For example, the fluid conduit, chamber and pneumatic conduit may be sized according to the size of the reservoir. The second opening of each of the reservoirs may be connected to a different second fluid conduit. In some embodiments, the second opening of each of the reservoirs corresponds to the base of the reservoirs. Each reservoir may be connected to the same second fluid conduit via a different opening on a side wall of the second fluid conduit. Each reservoir may be filled sequentially or concurrently depending on the selective application of pneumatic pressure to the reservoir via the pneumatic conduit and/or the second fluid conduit. Accordingly, valves such as pinch valves may be present in the pneumatic conduit of each chamber to toggle between open and close status of the conduit for control of the flow of reagent fluid in the reservoirs.

The chamber according to the present invention may be filled or pre-loaded with a liquid. The liquid may be a reagent liquid, a buffer, a sample or any other specified liquid. In some embodiments, wax such as paraffin wax is formed on at least a portion of the interior wall of the chamber. The wax may be formed using a deposition technique such as spin coating, painting, spraying, brushing, vapor deposition, roll coating and dipping. The wax in the chamber may have a volume of about 5 micro liter to about 30 micro liter, such as about 10 micro liter to about 30 micro liter, about 10 micro liter to about 20 micro liter, or about 10 micro liter.

The reagent fluid dispensing device of the present invention can be fabricated using traditional machining techniques such as microinjection molding and computerized numerically controlled (CNC) machining, or precision injection molding, as can be understood by persons skilled in the art. The interior surfaces of the chamber, reservoir and fluid conduits making up the reagent fluid dispensing device may be cleaned or sterilized where required. In some cases, the inner surfaces of the chambers and channels may be coated with another material so as to modify the surface properties of the surfaces. For example, at least a portion of the interior surface of the reagent fluid dispensing device may be made hydrophobic by coating with a suitable material, such as a hydrophobic polymer.

In a second aspect, various embodiments refer to a micro-fluidic device comprising a reagent fluid dispensing device according to the first aspect. In some embodiments, more than one reagent fluid dispensing device may be present in the micro-fluidic device. For example, more than one reagent fluid dispensing device, such as one, two, three or four reagent fluid dispensing devices may be arranged in series within the micro-fluidic device. The reagent fluid dispensing device may be used in combination with other units to form a micro-fluidic device. For example, the reagent fluid dispensing device may be integrated with a inter-connected multi-chamber device such as that exemplified in PCT/SG2008/000222, or a biochip such as that exemplified in PCT/SG2005/000251, to form an integrated cartridge for sample preparation and sample processing within the cartridge. The integrated cartridge can be adapted for use in an apparatus, such as that exemplified in PCT/SG2008/000425, for conducting and monitoring chemical reactions.

In a third aspect, various embodiments refer to a method of dispensing a reagent fluid. The method includes providing a reagent fluid dispensing device according to the first aspect. A reagent fluid may be provided in the reservoir. The method of the present invention includes applying pneumatic pressure to the chamber through the pneumatic conduit to transfer the reagent fluid from the reservoir to the chamber through the first fluid conduit.

In some embodiments, the method may include connecting a second fluid conduit to the reservoir to provide the reagent fluid by allowing the reagent fluid to flow through the second fluid conduit to the reservoir. The second fluid conduit may be flushed using pressurized air, for example, such that the reagent fluid is contained substantially within the reservoir, prior to dispensing of the reagent fluid into the chamber. In embodiments wherein the second fluid conduit and the reservoir are placed such that reagent fluid flows from second fluid conduit to the reservoir in an or partially in an upward direction against gravity, the reagent fluid may be contained within and held in place in the reservoir during flushing of the second fluid conduit due to pneumatic pressure applied on the reagent fluid by the pneumatic conduit. In some embodiments, the reservoir is dimensionalized for storing a predetermined amount of reagent fluid. Accordingly, by dispensing the reagent fluid that is contained substantially within the reservoir into the chamber, the amount of reagent fluid dispensed into the chamber can be predetermined. Pneumatic pressure may be applied to the reagent fluid through the second fluid conduit to transfer the reagent fluid from the reservoir to the chamber through the first fluid conduit.

The method may include applying wax on at least a portion of the interior wall of the chamber. The wax may be applied on at least a portion of the interior wall of the chamber at a temperature of less than 95° C. Generally, the temperature is about 60° C. for wax having a low melting point. In some embodiments, the wax is applied on at least a portion of the interior wall of the chamber prior to dispensing the reagent fluid in the chamber. The wax may be melted to form a layer of wax in the chamber prior to dispensing the reagent fluid in the chamber, in which the layer of wax may serve as a vapor seal for the reagent fluid in the chamber. In some embodiments, liquid wax (or paraffin oil) may be used. In this case, the liquid wax may be deposited into the chamber without the need to be applied on at least a portion of the interior wall of the chamber prior to dispensing the reagent fluid in the chamber The invention illustratively described herein may suitably be practiced in the absence of any element or elements, limitation or limitations, not specifically disclosed herein. Thus, for example, the terms "comprising", "including", "containing", etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the inventions embodied therein herein disclosed may be resorted to by those skilled in the art, and that such modifications and variations are considered to be within the scope of this invention.

The invention has been described broadly and generically herein. Each of the narrower species and subgeneric groupings falling within the generic disclosure also form part of the invention. This includes the generic description of the invention with a proviso or negative limitation removing any subject matter from the genus, regardless of whether or not the excised material is specifically recited herein.

Other embodiments are within the following claims and non-limiting examples. In addition, where features or aspects of the invention are described in terms of Markush groups, those skilled in the art will recognize that the invention is also thereby described in terms of any individual member or subgroup of members of the Markush group.

EXPERIMENTAL SECTION

In the following paragraphs, real-time PCR (RT-PCR) thermal cycling will be described. The real-time PCR (polymerase chain reaction) was performed by using an in-house fabricated thermal cycler. Generally, any thermal cycler may be used to perform the real-time PCR. The thermal cycler used includes a fan, a thermoelectric (TE) heater/cooler (9501/127/030, FerroTec), and a TE control kit (FerroTec, USA) including a FTA600 H-bridge amplifier and a FTC 100 temperature controller. The TE heater/cooler was powered by the FTA600 H-bridge amplifier, which was in turn controlled by the FTC100 temperature controller. A T-type thermocouple (5TC-TT-T-40-36, OMEGA Engineering) was mounted on the TE heater/cooler to measure the temperature, and used as a feedback to the FTC 100 temperature controller. The temperature difference between the TE heater and actual temperature inside the PCR chamber was calibrated by measuring the temperature inside the PCR chamber directly with a control sample made up from a same volume of PCR reagent and liquid wax.

Figure 1A:
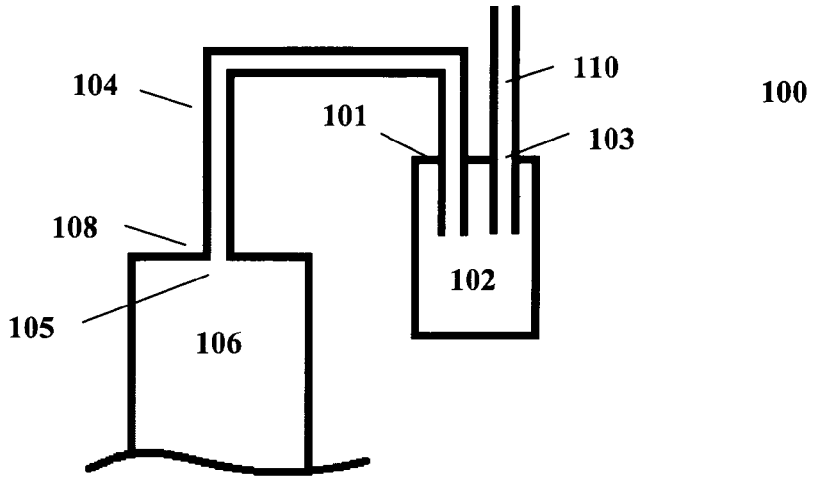
FIG. 1A is a schematic diagram of a reagent fluid dispensing device 100 according to an embodiment. The reagent fluid dispensing device 100 includes a chamber 102. The chamber 102 has a first opening 101 and a second opening 103. The reagent fluid dispensing device 100 further includes a first fluid conduit 104, which is connected to the first opening 101 of the chamber 102. A reservoir 106 is connected to the first fluid conduit 104. The reservoir 106 may be dimensionalized for storing a predetermined volume of the reagent fluid. The reservoir 106 has a first opening 105, which is connected to the first fluid conduit 104 to form a passive valve 108. A pneumatic conduit 110 is connected to the second opening 103 of the chamber 102.
Figure 1B:
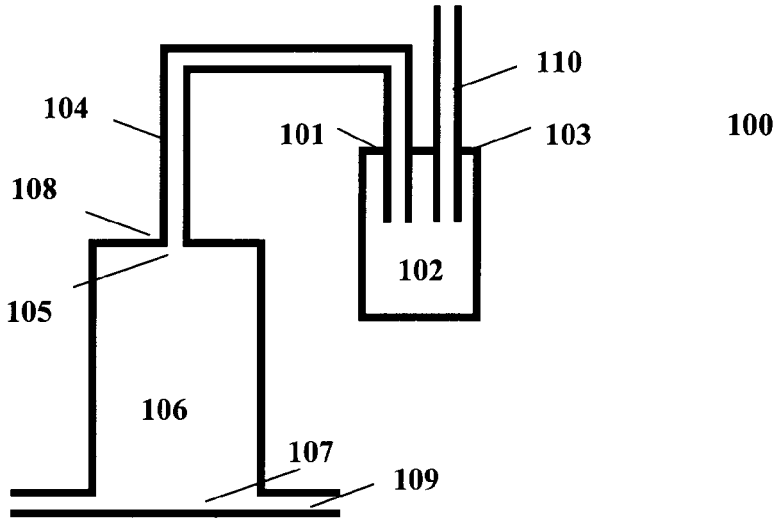
FIG. 1B is a schematic diagram of a reagent fluid dispensing device 100 according to another embodiment. In this embodiment, the reservoir 106 has a second opening 107. A second fluid conduit 109 is connected to the second opening 107 of the reservoir 106.
Figure 1C:
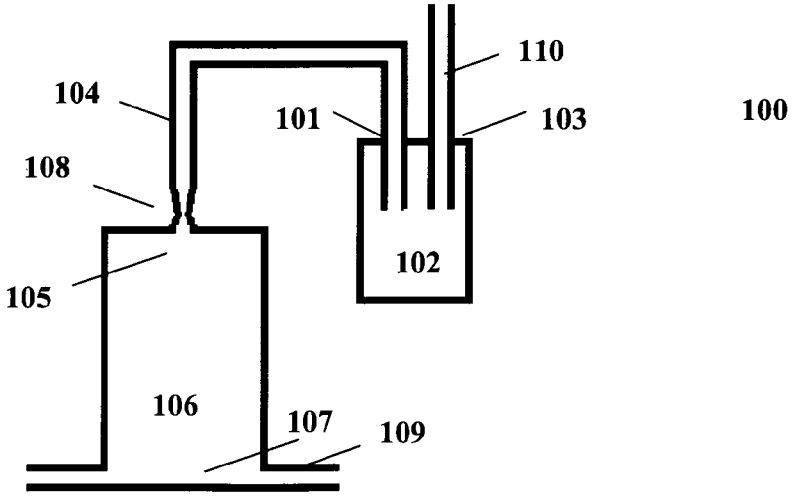
FIG. 1C is a schematic diagram of a reagent fluid dispensing device 100 according to a further embodiment. In this embodiment, the passive valve 108 has a smaller cross-sectional area than the cross-sectional area of the first fluid conduit 104.
Figure 1D:
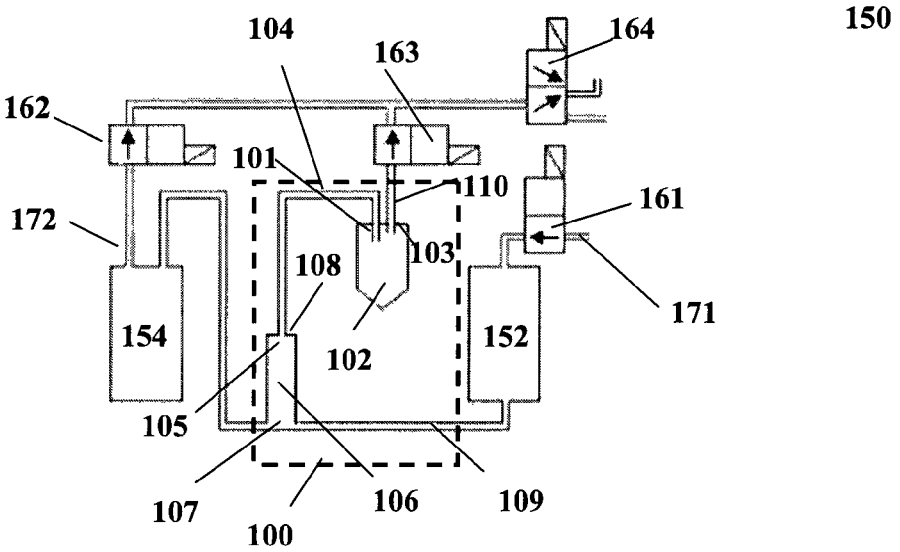
FIG. 1D is a schematic diagram of a micro-fluidic device 150 having a reagent fluid dispensing device 100 according to an embodiment. The micro-fluidic device 150 as shown includes a chamber 152, which can be used for example, to store the reagent fluid. The reagent fluid may enter the micro-fluidic device 150 via a fluid conduit 171. A valve 161 may be present to regulate the flow of the reagent fluid through the fluid conduit 171 into the chamber 152. The reagent fluid may flow into the reservoir 106 through the second fluid conduit 109 that is connected to the reservoir 106 via the second opening 107 of the reservoir 106. The reservoir 106 may be dimensionalized for storing a predetermined volume of the reagent fluid. Excess reagent fluid may be directed to a chamber 154 for storage. A pneumatic conduit 172 may be connected to the chamber 154. The pneumatic conduit 172 may be connected to the pneumatic conduit 110 of the chamber 102. Valves 162, 163 and 164 may be present in the pneumatic conduits to regulate pneumatic pressure through the conduits.
Figure 1E:
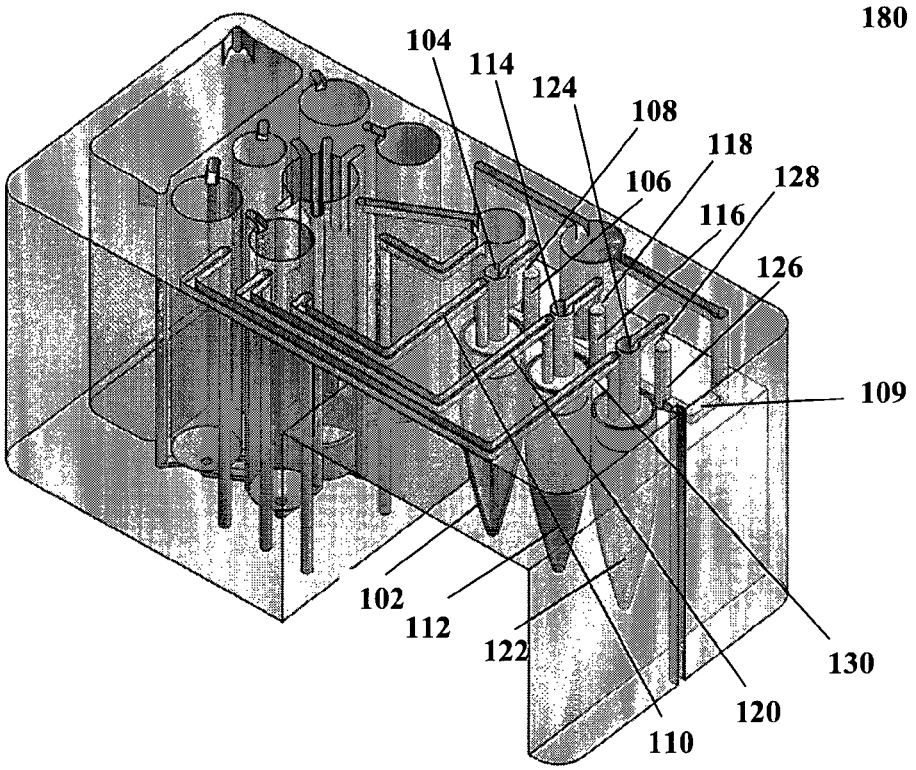
FIG. 1E is a three-dimensional schematic diagram of a micro-fluidic device 180 having a reagent fluid dispensing device according to an embodiment. The reagent fluid dispensing device as shown includes three reservoirs 106, 116 and 126, which are connected via their respective first fluid conduits 104, 114 and 124 to their respective chambers 102, 112 and 122. The reagent fluid may flow into each of the three reservoirs 106, 116 and 126 through the second fluid conduit 109 that is connected to the second opening of each reservoir. The reservoirs 106, 116 and 126 may be dimensionalized for storing a predetermined volume of the reagent fluid, wherein the volume of each reservoir may be the same or different. The reagent fluid may be filled to the level of each of the passive valves 108, 118 and 128. As shown in the figure, each of the chambers 102, 112 and 122 are connected to a pneumatic conduit 110, 120 and 130. The resultant of the pneumatic pressure to each chamber 102, 112 and 122 through each of their pneumatic conduits 110, 120 and 130 and the pneumatic pressure to the reagent fluid through the second fluid conduit 109 may be greater than the pressure required to transfer the reagent fluid through each passive valve 108, 118 and 128, such that the reagent fluid may flow into each chamber 102, 112 and 122 through the first fluid conduit 104, 114 and 124 that is connected to the first opening of each reservoir 106, 116 and 126.
Figure 1F:
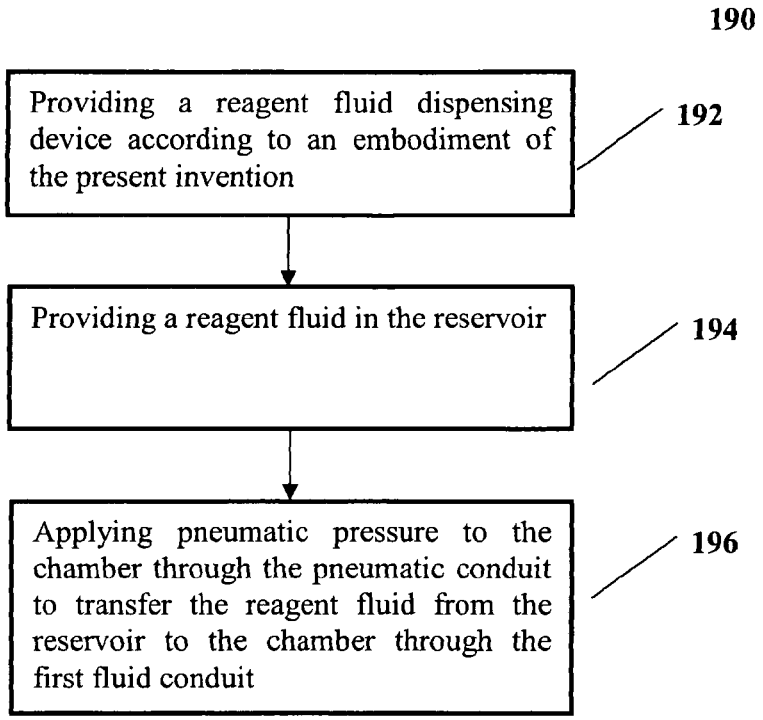
FIG. 1F is a flow diagram 190 of a method of dispensing a reagent fluid according to an embodiment. The method includes providing a reagent fluid dispensing device according to an embodiment 192, providing a reagent fluid in the reservoir 194 and applying pneumatic pressure to the chamber through the pneumatic conduit to transfer the reagent fluid from the reservoir to the chamber through the first fluid conduit 196.
Figure 2A:
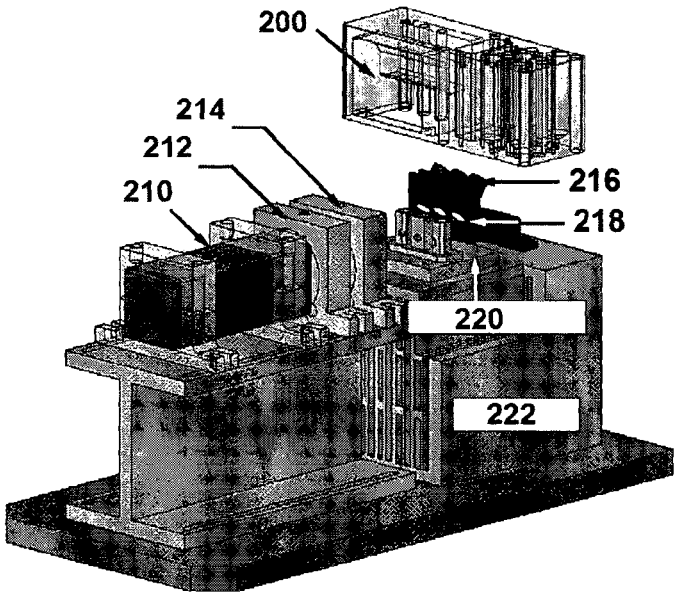
FIG. 2A is a schematic diagram of a real-time PCR (RT-PCR) system with integrated sample preparation and 3-channel fluorescence detection using an all-in-one cartridge according to one embodiment. The following notations are used in the figure. 200 denotes a microfluidic device containing a reagent fluid dispensing device according to an embodiment; 210 denotes a photomultiplier (PMT); 212 denotes an emission filter; 214 denotes a collimating lens; 216 denotes a light emitting diode (LED); 218 denote an excitation filter; 220 denotes a peliter heater; and 222 denotes a heat sink. This automated system is able to extract DNA/RNA from a sample, carry out reagent fluid dispensing, and perform RRT-PCR (real-time reverse transcriptase PCR) for disease diagnosis.

FIG. 2A is a schematic diagram of a real-time PCR (RT-PCR) system with integrated sample preparation and 3-channel fluorescence detection using an all-in-one cartridge according to one embodiment. This automated system is able to perform DNA/RNA extraction from a raw sample, reagent fluid dispensing, and RT-PCR for disease diagnosis.

The real-time PCR (RT-PCR) system includes three blue light-emitting diodes (LEDs) ($\lambda_p$=470 nm, $\Delta\lambda$=25 nm, LLB52050, Dotlight), a photo-multiplier tube (PMT) (H5784-20, Hamamatsu), a collimating lens (AC254-040-A1, Thorlabs), and a filter set (ex.: BG-12, Edmund; em.: HQ535/50m, Chroma) targeting for 6-carboxyfluorescein (FAM) and SYBR Green I fluorescent dyes. Fluorescence measurement was performed at the end of each extension cycle (usually at 72° C.) by sequentially lighting each LED for 200 ms using a power supply (NI9265, National Instrument). Fluorescence signals from excited fluorescent probes in the PCR chambers was collected and collimated to the PMT, where the acquired signal was averaged 50 times (within 200 ms) by a data acquication card (NI9206, National Instrument) at a sample rate of 1 kHz. The LEDs was tilted at 45° relative to the PCR tubes, so as to minimize the transmission of stray light to the PMT detector.

Figure 2B:
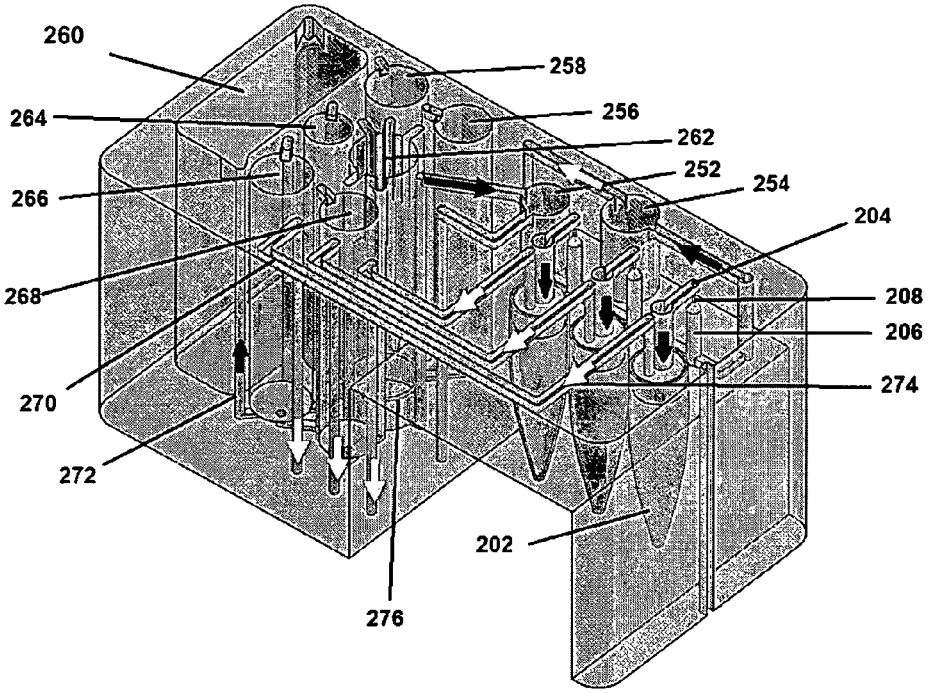
FIG. 2B is a schematic diagram of a cartridge according to an embodiment, depicting chambers for DNA/RNA extraction, reagent aliquot dispensing and real-time PCR. The following notations are used in the figure. 202 denotes a PCR vial or chamber; 204 denotes a first fluid conduit; 206 denotes a reservoir or metering chamber; 208 denotes a passive valve; 252 denotes an eluent chamber; 254 denotes an excess eluent chamber; 256 denotes a sample chamber; 258 denotes a wash 1 buffer; 260 denotes a waste chamber; 262 denotes a membrane chamber; 264 denotes an eluent buffer chamber; 266 denotes a wash 2 buffer chamber; 268 denotes an ethanol flush chamber; 270 denotes a connection trench; 272 denotes a fluidic channel; 274 denotes a pneumatic channel; 276 denotes a silica membrane in the membrane chamber. In some embodiments, the dimensions of the chambers may be as follows. Reservoir 206 may be about 10 μl; eluent chamber 252 may be about 0.3 ml; excess eluent chamber 254 may be about 0.3 ml; sample chamber 256 may be about 1 ml; wash 1 buffer chamber 258 may be about 0.7 ml; waste chamber 260 may be about 5 ml; membrane chamber 262 may be about 1 ml; eluent buffer chamber 264 may be about 0.4 ml; wash 2 buffer chamber 266 may be about 0.7 ml; ethanol flush chamber 268 may be about 0.7 ml. The reagents for DNA/RNA extraction may be preloaded into the cartridge and sealed by adhesive films. The PCR pre-mixtures may be frozen and stored in standard 0.2-ml PCR chambers or PCR tubes, and may be inserted into the cartridge prior to use. The black arrows represent reagent flow, while white arrows represent negative pressure applied.

In the following paragraphs, microfluidic device fabrication will be described. FIG. 2B is a schematic diagram of a cartridge according to an embodiment of the present invention. The diagram shows chambers for DNA/RNA extraction, reagent aliquot dispensing and real-time PCR. The reagents for DNA/RNA extraction were preloaded into the cartridge and sealed by adhesive films. The PCR pre-mixtures were frozen and stored in standard 0.2-ml PCR chambers or PCR tubes, and were inserted into the cartridge prior to use. The black arrows represent reagent flow, while white arrows represent negative pressure applied.

The all-in-one cartridge (33.7 mm×34.1 mm×69.1 mm) was made from polymethylmethacrylate (PMMA), designed with SolidWorks, and fabricated by computer numeric control (CNC) machine (Whits Technologies, Singapore). The connection trench was 1 mm in height and 1 mm in width. The through-cartridge pneumatic and fluidic channels were 1 mm in diameter. The chamber volume was designed to accommodate the required amount of reagents (Qiagen DNA/RNA extraction kit).

To remove oils and contaminants, cartridges were soaked in 0.2% of detergent (Decon 90, Decon Lab. Ltd.) for 12 hours, rinsed thoroughly with de-ionized water, and oven-dried at 60° C. for 6 hours. Subsequently, the cartridges were dip-coated with 0.5% (w/w) of DuPont AF 1600 fluoropolymer dissolved in 3M FC-40 Fluorinert (filtered with a 10 μm membrane filter (Vacu-Guard, Whatman)), and oven-dried at 60° C. overnight.

The Teflon-coated cartridge may be soaked in 3% $H_2O_2$ (MGC Pure Chemicals) for 12 hours, rinsed with 0.1% diethyl pyrocarbonate (DEPC, Sigma-Aldrich) to remove RNases and DNases, and oven-dried at 60° C. for 6 hours. The Fujifilm silica membrane for DNA/RNA extraction (Fujifilm Quickgene RNA Cultured Kit S) was inserted in the bottom of the membrane chamber. The top and bottom of the cartridge were then sealed with MicroAMP optical adhesive film (4306311, Applied Biosystems).

Referring to FIG. 2B, the following notations were used. 202 denotes PCR vials or chambers; 206 denotes metering chambers or reservoirs; 208 denotes passive valves; 252 denotes an eluent chamber; 254 denotes an excess eluent chamber; 256 denotes a sample chamber; 258 denotes a wash 1 buffer chamber; 260 denotes a waste chamber; 262 denotes a membrane chamber; 264 denotes an eluent chamber; 266 denotes a wash 2 buffer chamber; 268 denotes a ethanol flush chamber; 270 denotes a connection trench; 272 denotes a fluidic channel; 274 denotes pneumatic channels; 276 denotes a silica membrane.

Figure 2C:
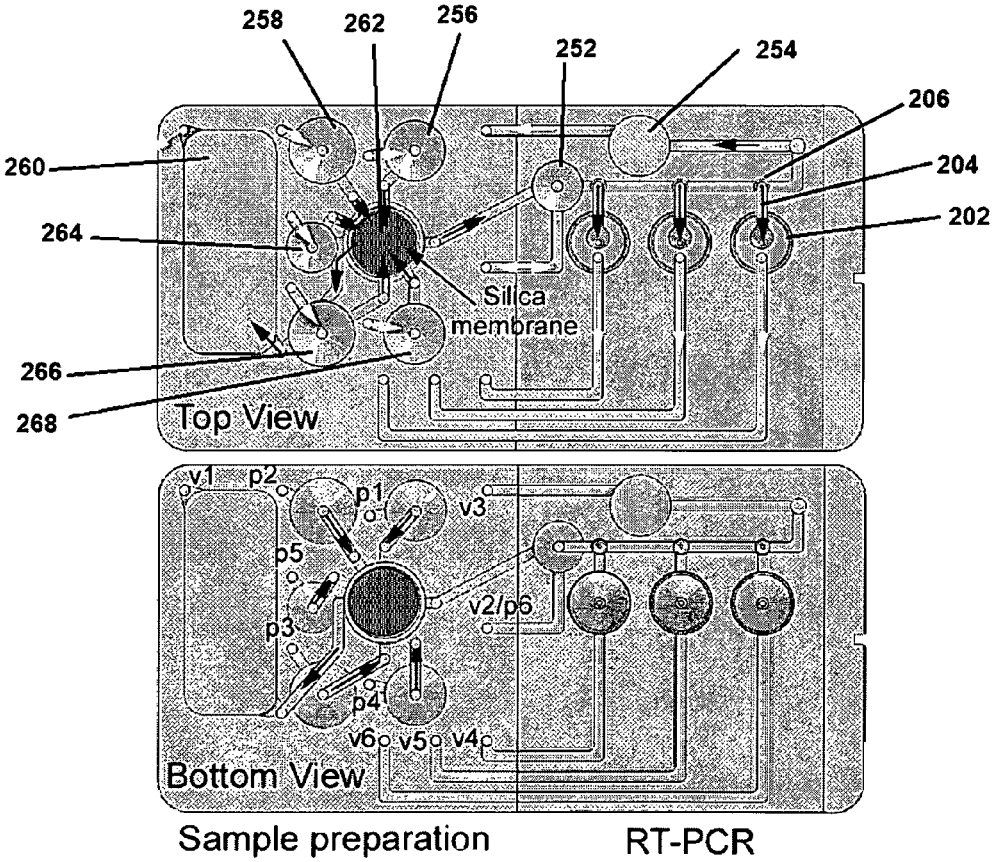
FIG. 2C is a schematic diagram of the top and bottom views of a cartridge according to an embodiment such as that shown in FIG. 2B. The same notations as that used in FIG. 2B are used. The schematic diagram of the bottom view of the cartridge is labeled with a first pressure inlet p1, a second pressure inlet p2, a third pressure inlet p3, a fourth pressure inlet p4, a fifth pressure inlet p5 and a sixth pressure inlet p6, as well as a first vacuum inlet v1, a second vacuum inlet v2, a third vacuum inlet v3, a fourth vacuum inlet v4, a fifth vacuum inlet v5 and a sixth vacuum inlet v6. Reagent fluid pumping may be achieved using either air pressure or vacuum, or a combination of air pressure and vacuum. The air pressure and vacuum may be generated using two syringe pumps in a push-pull set-up. The black arrows represent reagent flow, while white arrows represent negative pressure applied.

In the following paragraphs, fluidic pumping and regulation will be described. FIG. 2C is a schematic diagram of the top and bottom views of the all-in-one cartridge specified with pressure inlets (p1 to p6) and vacuum inlets (v1 to v6). Two in-house fabricated syringe pumps with a volume of 25 mL each were used to generate the air pressures and vacuum forces. These syringe pumps were driven by a linear actuator (E43H4N-12, Haydon) and a step motor driver (DCS 4010, Haydon) with a maximum flow rate of 12 ml/min. The air pressures and vacuum forces at pressure inlets (p1 to p6) and vacuum inlets (v1 to v6) were regulated by separate pinch valve manifold (P/N 075P2NC12-23S, Bio-Chem Fluidics) powered by a 15-V power source (S-35-15, MeanWell). These pneumatic forces were connected to the cartridge via o-rings and pneumatic connectors (M-3AU, SMC), which pierce through the bottom sealing film upon cartridge loading. The entire system was controlled using a LabView (National Instruments) program.

In the following paragraphs, sample preparation will be described. RNA extraction was carried out using the reagents from QIAamp Viral RNA Mini Kit (Qiagen) based on the manufacturer's instructions. Serial dilutions (1 to $10^4$ folds or 1000 to 0.1 ng/μl) of mouse total liver RNA (10 μl) were added with 280 μl of AVL buffer, 2.8 μl of carrier RNA (1 μg/μl in AVE buffer) and 160 μl of nuclease-free water (AM9938, Applied Biosystems) in a 1.5 ml tube. The mixture was incubated at room temperature for 10 minutes. Subsequently, 280 μl of ethanol (96 to 100%) was added to the mixture, which was then transferred to the DEPC-treated cartridge (sample chamber).

The RNA extraction was demonstrated using the reagents from QIAamp Viral RNA Mini Kit (Qiagen) based on the manufacturer's instructions. Serial dilutions (1 to $10^4$ folds or 1000 to 0.1 ng/μl) of mouse total liver RNA (10 μl) were added with 280 μl of AVL buffer, 2.8 μl of carrier RNA (1 μg/μl in AVE buffer) and 160 μl of nuclease-free water (AM9938, Applied Biosystems) in a 1.5-ml tube. The mixture was incubated at room temperature for 10 min. Next, 280 μl of ethanol (96 to 100%) was added to the mixture, which was then transferred to the DEPC-treated cartridge (sample chamber (256)). The cartridge was preloaded with QIAamp's reagents as follows: 500 μl of wash buffer AW1 was introduced to Wash 1 buffer chamber (258), 500 μl of wash buffer AW2 was loaded in Wash 2 buffer chamber (266), 200 μl of elution buffer was introduced to Eluent buffer chamber (264), and 500 μl of ethanol (96 to 100%) was loaded in Ethanol flush chamber (268). The cartridge (top layer) was re-sealed with MicroAMP optical adhesive film, and loaded into the fluidic pumping unit, which performed the DNA/RNA extraction automatically.

Control experiments were performed with QIAamp Mini Spin Column according to the manufacturer's protocol. Briefly, the sample mixture (same mixture as in the cartridge experiment) was transferred to the spin column, spun at 8000 rpm for 1 min, washed with 500 μl of wash buffer AW1 (8000 rpm, 1 min), washed with 500 μl of wash buffer AW2 (14000 rpm, 3 min), and eluted with 200 μl of AVE elution buffer (8000 rpm, 1 min). A second control with untreated mouse liver total RNA was also studied with an adjusted RNA concentration according to the elution buffer volume (200 μl). Briefly, 10 μl of serially diluted (1 to $10^4$ folds or 1000 to 0.1 ng/μl) liver total RNA was added with 190 μl of nuclease-free water. The RNA extraction efficiency was measured by RT-PCR.

In the following paragraphs, measurements of on-cartridge RNA extraction and real-time PCR will be described. Mouse liver total RNA was selected for characterizing the RNA extraction efficiency of the all-in-one cartridge system. RT-PCR was performed with Taqman RNA-to-$C_T$ 1-Step Kit (4392938, Applied Biosystems) in a Bio-Rad CFX-96 instrument with 20 μl of reaction mixture, which includes 0.5 μl of TaqMan RT Enzyme Mix, 10 μl of TaqMan RT-PCR Mix, 1 μl of Taqman Assays-by-Design (Mm99999915_g1), and 8.5 μl of serial diluted purified or unpurified mouse liver total RNA (7810, Ambion). The RRT-PCR (real-time reverse transcriptase-polymerase chain reaction) was conducted at 48° C. for 15 min and 95° C. for 10 min, with 40 cycles of 95° C. for 15 s and 60° C. for 60 s.

Mouse glyceraldehyde 3-phosphate dehydrogenase (GAPDH) was selected for the evaluation of thermal cycler according to an embodiment and real-time PCR detection system. Mouse liver total RNA (1000 ng, 7810, Ambion) was reverse transcripted using Taqman Reverse Transcription Kit (N8080234, Applied Biosystems) performed in a Bio-Rad CFX-96 instrument with 100 μl of reaction mixture, according to the manufacturer's protocol. The randomly reverse transcripted cDNA mixture (containing GAPDH cDNA and other cDNAs) was serially diluted by 1 to $10^6$ folds with nuclease-free water (AM9939, Applied Biosystems), and amplified using Taqman Fast Universal PCR master mix (4352042, Applied Biosystems) and Taqman Assays-by-Design containing primers and probe encoding for GAPDH (Mm99999915_g1, Applied Biosystems), according to the manufacturer's instructions with the thermal cycler according to an embodiment. Briefly, 20 μl of PCR mixture was covered with 15 μl of liquid wax (Chill-out™ Liquid Wax, Bio-Rad), and subjected to 95° C. for 5 min, and 40 cycles of 95° C. for 5 s and 60° C. for 60 s (for combined annealing and extension). Fluorescence arising from DNA replication was recorded as a function of cycle number.

In the following paragraphs, seasonal influenza screening and sub-typing will be described. Patients' nasopharyngeal swab samples (in viral transport media (UTM-RT 330C; COPAN)) were provided by the Molecular Diagnosis Centre of National University Hospital, Singapore. These samples were collected for the 2009-H1N1 screening activity with the Institutional Review Board (IRB) approval. They were serially diluted by 1 to $10^4$ folds with viral transport media (AM9939, COPAN), and the influenza viral RNA (200 μl) was extracted using either the all-in-one cartridge or the QIAgen spin column with chemicals from QIAamp Virus RNA Mini Kit (Qiagen), following the protocols described in the sample preparation section. RRT-PCR was performed with the influenza A virus matrix gene-specific primers and probe for influenza A typing, and H1-specific primers and probes for seasonal H1N1 sub-typing (Table 1 in FIG. 15). All probes were labeled at the 5' end with the 6-carboxyfluorescein (FAM) reporter dye, and at the 3' end with the 6-carboxytetramethylrhodamine (TAMRA) quencher dye. The RRT-PCR assays were performed using a Qiagen QuantiTect RT Probe Kit (one-step RT-PCR) with 40 μl of reaction mixture, including 0.4 μl of QuantiTech RT Mix, 20 μl of QuantiTect Probe RT-PCR Master Mix, 20 pmol of each primer, 10 pmol of probe, and 10 μl of extracted RNA mixture. The RRT-PCR was performed at 50° C. for 20 min, 95° C. for 2 min, with 50 cycles of 95° C. for 30 s, 50° C. for 30 s and 72° C. for 30 s, and with the final extension at 72° C. for 10 min. This was conducted with the thermal cycler (with all-in-one cartridge) according to an embodiment or the Bio-Rad CFX96 thermal cycler (control).

For the all-in-one system, PCR tubes were preloaded with 30 μl of the RRT-PCR mixture (without the target RNA), which were covered with 15 μl of liquid wax (Chill-out™ Liquid Wax, Bio-Rad). They were inserted onto the all-in-one cartridges prior to sample extraction. During sample extraction, 10 μl of extracted viral RNA was automatically dispensed as an aliquot into each PCR tube. Thermal cycling and detection were subsequently be performed by the system's real-time PCR hardware.

In the following paragraphs, device operation will be described. Prior to operation, the RNA extraction reagents (QIAamp Viral RNA Mini Kit, recommended by WHO for influenza virus RNA extraction) were preloaded in the respective chambers of the all-in-one cartridge, and the top and bottom surfaces of the cartridge were sealed with MicroAMP adhesive tape. The preloaded PCR tubes were also inserted into the cartridges (FIG. 2B). The operator introduced the biological sample into the designated sample chamber via a syringe needle. Upon loading the cartridge into the system, the pneumatic connectors of the system automatically pierced the cartridge's bottom film, and connected the pressure and vacuum inlets of the cartridge to the external pneumatic system (FIG. 2C).

According to various embodiments, the manipulation of fluids was achieved by using a combination of compressed air and vacuum. These push and pull forces, respectively, were generated by two syringe pumps according to an embodiment. The pneumatic forces were directed to the appropriate chambers within the cartridge using two pinch-valve manifolds. The syringe pumps and pinch-valve manifolds provided an external pneumatic system, which control the fluidic motion within the chambers of the cartridge (FIG. 3). As the cartridge is designed with no movable components, which greatly simplifies the cartridge assembly and allows for mass production of cartridges via injection molding, therefore cartridge costs may be significantly reduced.

The cartridge may provide two separate pneumatic and fluidic networks. Each chamber may provide one pneumatic inlet (connected to the top of chamber) and two fluidic connection points (bottom outlet and top inlet). The two chambers may be connected by a through-cartridge fluidic channel. On connection to a pump, for example, pressure and vacuum forces may be applied to the chambers, such that a pressure gradient may be present between the two chambers. In this way, the reagent is forced to drain from the bottom of the source chamber, flow up the through-cartridge fluidic channel, and enter the target chamber. Unlike the planar microfluidic structures, which often required on-chip valves for separating and directing fluids between chambers, the reagent within the cartridge's chambers may automatically be isolated due to gravity. In view that the reagent may be self-contained within fluidic channels and chambers throughout the entire operation, this may also mean that potential run-to-run and hardware cross contaminations may be eliminated.

The overall operation of the all-in-one cartridge is illustrated using the schematic diagram in FIG. 3A(I). The following notations are used in the figure. C1 denotes a sample chamber; C2 denotes a Wash 1 buffer chamber; C3 denotes a Wash 2 buffer chamber; C4 denotes an ethanol chamber; C5 denotes an elution buffer chamber; C6 denotes a waste chamber; C7 denotes an eluent chamber; C8 denotes an excess eluent chamber; X1 denotes a silica membrane chamber; p1 refers to a first (pressure) pinch valve; p2 refers to a second (pressure) pinch valve; p3 refers to a third (pressure) pinch valve; p4 refers to a fourth (pressure) pinch valve; p5 refers to a fifth (pressure) pinch valve; p6 refers to a sixth (pressure) pinch valve; v1 refers to a first (vacuum) pinch valve; v2 refers to a second (vacuum) pinch valve; v3 refers to a third (vacuum) pinch valve; v4 refers to a fourth (vacuum) pinch valve; v5 refers to a fifth (vacuum) pinch valve; v6 refers to a sixth (vacuum) pinch valve; T1 refers to a first PCR chamber (or PCR tube), T2 refers to a second PCR chamber (or PCR tube); T3 refers to a third PCR chamber (or PCR tube); and M1 refers to a first reservoir (or aliquot chamber); M2 refers to a second reservoir (or aliquot chamber); M3 refers to a third reservoir (or aliquot chamber)

The status of the pinch valves is denoted using the symbols "X" and arrows (↑ or ↓). A symbol "X" at the pinch valve denotes that the valve is closed, whereas the use of arrows ↑ or ↓ at the pinch valve denotes that the valve is opened. The direction of pressure applied (for p1 to p6) or vacuum applied (for v1 to v6) is indicated by the direction of the arrows.

With reference to FIG. 3A(I), T1 to T3 are PCR chambers or PCR tubes containing RT-PCR pre-mixtures, wherein the RT-PCR pre-mixtures contain RT-PCR mixtures (without the target RNA) and liquid wax. The biological sample may be loaded into the sample chamber C1 by a needle syringe, and the cartridge is re-sealed with an adhesive tape. By opening valves p1 and v1 (while keeping the other valves closed) and applying a pressure and vacuum respectively across the valves in the direction indicated by the arrows, the biological sample containing target RNAs may be transferred to chamber X1, where it is lysed and filtered through the silica membrane. The RNAs are captured by the membrane, and the filtrate waste may be directed to the waste chamber C6. The impurities (trapped within the silica membrane) may be washed out sequentially using Wash 1 buffer contained in C2, Wash 2 buffer contained in C3, and ethanol contained in C4 (flow rate: 1 ml/min). The reagents is directed to the chamber X1 sequentially by opening each of valves p2, p3 or p4 in turn with v1, and applying a pressure across p2 to p4 and vacuum across v1. Subsequently, chamber X1 is extensively flushed with air (flow rate=10 ml/min; 2 min) to remove the remaining wash buffer residue.

Referring to FIG. 3A(II), the purified RNA is released from the silica membrane after the purification process, when the low ion concentration elution buffer passes through the silica membrane. The elution buffer with RNA is directed to the eluent chamber C7 by opening valves p5 and v2, and applying a pressure and vacuum respectively across the valves (while keeping the other valves closed).

In FIG. 3A(III), valves v3 to v6 and p6 are opened (with the other valves closed), and vacuum is applied across v3 to v6 valves and pressure applied across p6. By applying this pressure gradient mechanism across the system, the elution mixture in the eluent chamber C7 is dispensed as aliquots by gradually filling up the three aliquot metering chambers M1 to M3 sequentially (flow rate=0.1 ml/min), while the excess elution mixture is delivered to the excess eluent chamber C8.

In FIG. 3A(IV), valves v3 and p6 are opened (with the other valves closed) and vacuum is applied across v3 and pressure was applied across p6. Purified RNA which remains within the connection channel is air-flushed to the excess eluent chamber C8 (flow rate=5.62 ml/min), while the RNA aliquots or reagent fluids are held in position with the help of surface tension within the aliquot chambers.

Referring to FIG. 3A(V) and FIG. 3A(VI), the RNA aliquots are dispensed into the PCR tubes or chambers T1 to T3 containing RT-PCR pre-mixture. As the RNA sample is denser, it passes through a thin layer of liquid wax that covers the RT-PCR mixture directly into the RT-PCR mixture. The liquid wax with a lower density than PCR mixture prevents the evaporation of reagent during PCR thermal cycling.

In the following paragraphs, dispensing of reagent aliquots will be described. Disease diagnosis or screening may require multiple PCRs to be conducted on aliquots of extracted RNA for disease typing, sub-typing, and positive control (to ensure the activity of PCR enzyme mixture). In the present approach, the concept of aliquot metering and surface tension valve to precisely dispense the extracted RNA samples in each of three PCR vials or chambers may be used. FIG. 4A is a schematic diagram of a reagent fluid metering and aliquot dispensing device using passive valves. As mentioned in the description for FIG. 3A(III) and FIG. 3A(IV), extracted RNA may sequentially be filled to the constriction of the passive valve of the three aliquot reservoirs M1 to M3, and the remaining fluid in the connection channel may be air-flushed.

In other words, by designing each aliquot reservoir such that the volume of each aliquot reservoir corresponds to the target volume of the extracted RNA applied to the each PCR tube, the amount of extracted RNA that is applied to the PCR tubes can be administered accurately in a simple manner. FIG. 5A to FIG. 5I are time sequence photographs of aliquot dispensing of RNA eluent using a reagent fluid metering device according to an embodiment. The RNA eluent was coloured with blue food dye. In FIG. 5A, the eluent has passed through the silica membrane in X1 and was being transferred to the eluent chamber C7. In FIG. 5B, the eluent began to fill up the eluent chamber C7. In FIGS. 5C to 5E, reservoirs M1 to M3 were sequentially filled up to the constriction or passive valve of the reservoirs. In FIG. 5F, excess eluent was directed to the excess eluent chamber C8 and the connection line to the reservoirs was flushed. In FIGS. 5G to 5I, the fluid within each aliquot reservoir was isolated, and precise volumes of the eluent were dispensed into the respective PCR tubes T1 to T3 (indicated as 1 to 3 in the figure).

FIG. 4B is a graph depicting accuracy of fluid aliquots dispensed across the three aliquot reservoirs with a target volume of 10 μl. The average volume measured with water (in 16 repetitions) across the three PCR vials was 9.8 μl to 10.2 μl, with a standard deviation of 0.7 μl to 0.9 μl. The variations could be attributed to the cartridge fabrication by CNC milling, and the fluid shear at the bottom of the meters during the connection channel air flush. These variations may be minimized by adopting precision injection molding for cartridge fabrication, and by reducing the dimensions of the connection channel.

In the following paragraphs, RNA extraction will be described. RNA extraction in an exemplary sample preparation for RT-PCR requires several steps. Firstly, RNA was adsorbed onto the silica surface under a high ionic strength. The unbound impurities may be washed away, and the adsorbed RNA was released into solution under a higher pH. These manual, labor-intensive processes have been integrated in the on-cartridge RNA extraction according to an embodiment.

Qiagen Viral RNA Mini Kit was used to extract serial diluted mouse liver total RNA (0.1 to 1000 ng/μl). Next, one-step RRT-PCR (with reverse transcription and cDNA amplification combined in the same mixture) was employed to amplifiy the mouse GAPDH gene using a commercial thermal cycler (Bio-Rad CFX-96). Control experiments were performed with either Qiagen spin column or original untreated sample. The mouse liver total RNA was chosen to mimic clinical biological sample with co-existing human total RNA and virus RNA. The on-cartridge extraction of total liver RNA gave a linear curve with respect to RT-PCR amplification (FIG. 6 inset), indicating that RNA may quantitatively be re-isolated with high purity. Compared with the Qiagen spin column experiment (control), rather similar cycle threshold ($C_T$) (Table in FIG. 22) and amplification efficiency (FIG. 6 inset) (spin column: 97% vs. on-cartridge extraction: 87%) may be obtained for the mouse GAPDH RRT-PCR. The variance may most likely be due to the inherently lower efficiency of one-step RT-PCR, as indicated by the low efficiency of the original unpurified sample (94%).

In the following paragraphs, real-time PCR thermal cycling will be described. A thermoelectric module with heat sinks and fan was utilized for thermal cycling. FIG. 7A illustrates the temperature profiles of the thermal cycler obtained from a feedback temperature sensor. Temperatures at the heater surface and within the PCR chamber were measured and calibrated. The heating and cooling rates estimated from FIG. 7A are 2.5° C./s and 2.2° C./s, respectively, which were comparable with those of commercial thermal cyclers. The overshoot was less than 1° C. for each temperature setting, and thermal stability was maintained within ±0.1° C. The achieved thermal control and stability fulfilled the PCR requirements.

The all-in-one cartridge contains three 0.2-ml PCR tubes for disease typing, sub-typing and positive control. These three tubes were subjected simultaneously to the same PCR cycling conditions. FIG. 8 shows the on-cartridge real-time fluorescence curves and cycle thresholds of serial diluted (1 to $10^6$ folds) mouse GAPDH cDNA (see FIG. 9A to FIG. 9C for real-time fluorecence signals). The PCR detection system covered a highly linear (with $R^2$ correlation coefficient of >0.994) dynamic range of 7 orders of magnitude with a comparable amplification efficiency as the commercial real-time thermal cyclers (Bio-rad CFX96 and MJ Research Option). FIG. 7B shows the real-time PCR curves of the (○) left, (◇) center and (□) right PCR tubes, conducted with 10-fold diluted GAPDH cDNA mixture. As can be seen from the figure, the normalized fluorescence intensities were highly consistent across the three PCR tubes.

In the following paragraphs, rapid flu diagnosis and sub-typing will be described. Influenza virus typing and sub-typing need to be identified, especially for proper H1N1 diagnosis as recommended by World Health Organisation (WHO). To demonstrate this important multiplexing capability, on-cartridge detection was conducted with a nasopharyngeal swab sample from a patient whom was infected by seasonal influenza A H1N1. Two of the three on-cartridge PCR vials contained the primers and TaqMan probe for influenza A typing and H1 sub-typing, respectively. The RNA of the patient's sample extracted on-cartridge was directly subjected to on-cartridge PCR typing and sub-typing in these two vials. The third vial (positive control) consisted of the RNA from the same patient sample extracted by Qiagen Spin Column, and influenza A typing primers and probe. It was employed to verify the functionality of the real-time PCR hardware and on-cartridge RNA extraction. The all-in-one system effectively identified that the patient has a type A influenza ($C_T$=24.23) with a H1 sub-type ($C_T$=27.45) (see FIG. 10). The higher $C_T$ value for the H1 sub-typing may be due to the difference in primers and probes for flu typing and sub-typing. The RNA extraction and detection was performed entirely within the all-in-one system, and was completed within 2.5 h (approximately 20 min for RNA extraction, approximately 20 min for reverse transcription, and approximately 110 min for 50 cycles of PCR detection).

The sensitivity of the all-in-one system was further investigated with serial diluted influenza A nasopharyngeal swab samples (1 to $10^4$ folds diluted with viral transport media), and benchmarked against the conventional approach of manual Qiagen Spin Column extraction and Bio-Rad CFX96 real-time detection. A control experiment was also conducted with on-cartridge purified RNA (pipetted from the Excess Eluent Chamber), and with detection using Bio-Rad CFX96 system.

As shown in FIG. 11, the all-in-one system was able to detect $10^3$-fold diluted influenza A with a PCR efficiency of 90%, while the conventional approach and control experiment were able to detect as low as $10^4$-fold dilution with 99% PCR efficiency. In addition, a larger number of cycles was required for the all-in-one system ($\Delta C_T$=2.71 to 3.72) and the control experiment ($\Delta C_T$=1.34 to 1.75), as compared to that for the conventional approach (see Table in FIG. 23). The close to perfect RT-PCR amplification efficiency (99%) of the control experiment with the on-cartridge extracted RNA suggested that the purified RNA reagents were free of RT-PCR inhibitors. The slightly higher $C_T$ value of the control experiment versus the conventional approach may be due to the difference in RNA extraction efficiency (associated with the difference in surface area) of the Fujifilm silica membrane (thin film) and the Qiagen silica column (3-dimensional column) employed in the on-cartridge RNA extraction and conventional extraction, respectively.

The all-in-one system may have a slightly lower RT-PCR amplification efficiency (90%), as compared to the control experiment (99%). The all-in-one system may have comparable sensitivity and amplification efficiency as the MJ Research Opticon and Bio-Rad-CFX96 (FIG. 8). Thus, the issue may be unlikely to be associated with the device instrumentally. It may be hypothesized that insufficient mixing of extracted RNA with the RT-PCR pre-mixture could be the cause of the observed difference. In the all-in-one system, the extracted RNA may simply be dispensed into PCR vials without active mixing, thus more time may be needed for RNA diffusion in annealing with primers for the reverse transcription process, leading to an increase in $C_T$ values or the failure of RT-PCR (see FIG. 12). Improvement in processing may be achieved by incorporating a magnetic-initiated mixing in the future. Despite this issue, the all-in-one system was successfully demonstrated as a self-contained influenza diagnostic kit with a minimum viral load requirement of about $10^5$ copies/ml, a $10^3$-fold dilution of the mean viral load of seasonal influenza A ($3.28\times10^8$ copies/ml). This system may also be applied for other disease diagnoses, such as the pandemic 2009-H1N1 influenza, which has a mean patient viral load of $1.84\times10^8$ copies/ml.

The system according to various embodiments integrates sample preparation and real-time RT-PCR in a cartridge with multiplexing capability for rapid influenza diagnosis. All the necessary chemicals for virus particle lysis, viral RNA purification and RT-PCR detection, as well as the processed wastes are essentially self-contained and completely sealed within the disposable cartridge, thereby eliminating any potential virus exposure and hardware contamination. Through various embodiments, the system has also been shown to automatically perform the sample preparation and diagnosis within 2.5 h. This fully automated process may be achieved with a push-pull fluidic pump method, and a novel cartridge design that consisted of a silica membrane, pneumatic and fluidic networks, fluidic meters and surface tension valves. The fluidic control may be realized with synchronized pressure and vacuum forces implemented by an off-cartridge pneumatic control unit. While this work was demonstrated with machined cartridges for fast prototyping and quick turnaround in design optimization, the polymer cartridges may be easily mass fabricated by injection molding inexpensively and with high precision.

Seasonal influenza A H1N1 typing and sub-typing of clinical samples were successfully achieved using the all-in-one system with comparable sensitivity as experiments conducted using manual RNA extraction and commercial thermal cycler. The minimum detectable viral load determined by serial dilution experments was 100 copies/μl. The cartridge design was flexible, and may be extended to accommodate multiple channels (such as for 5-color, 5 -channel detection), without significant design modifications. This may enable the simultaneous detection of a panel of respiratory virus infections. In short, a practical, low-cost, and fully automated desktop system that may be suitable for decentralized infectious disease diagnosis may be provided according to various embodiments.

SEQUENCE LISTING

<160> NUMBER OF SEQ ID NOS: 6

<210> SEQ ID NO 1
<211> LENGTH: 24
<212> TYPE: DNA
<213> ORGANISM: Artificial Sequence
<220> FEATURE:
<223> OTHER INFORMATION: Influenza A Forward

<400> SEQUENCE: 1 agatgagtct tctaaccgag gtcg 24

<210> SEQ ID NO 2
<211> LENGTH: 24
<212> TYPE: DNA
<213> ORGANISM: Artificial Sequence
<220> FEATURE:
<223> OTHER INFORMATION: Influenza A Reverse

<400> SEQUENCE: 2 tgcaaaaaca tcttcaagtc tctg 24

<210> SEQ ID NO 3
<211> LENGTH: 20
<212> TYPE: DNA
<213> ORGANISM: Artificial Sequence
<220> FEATURE:
<223> OTHER INFORMATION: Influenza A Probe; comprising 6-
carboxyfluorescein (FAM) at the 5' end and 6-
carboxytetramethylrhodamine (TAMRA) at the 3' end.
<220> FEATURE:
<221> NAME/KEY: misc_binding
<222> LOCATION: (1)..(1)
<223> OTHER INFORMATION: 6-carboxyfluorescein (FAM)
<220> FEATURE:
<221> NAME/KEY: misc_binding
<222> LOCATION: (20)..(20)
<223> OTHER INFORMATION: 6-carboxytetramethylrhodamine (TAMRA)

<400> SEQUENCE: 3 tcaggccccc tcaaagccga 20

<210> SEQ ID NO 4
<211> LENGTH: 24
<212> TYPE: DNA
<213> ORGANISM: Artificial Sequence
<220> FEATURE:
<223> OTHER INFORMATION: Seasonal H1N1 Forward

<400> SEQUENCE: 4 aacatgttac ccagggcatt tcgc 24

<210> SEQ ID NO 5
<211> LENGTH: 24
<212> TYPE: DNA
<213> ORGANISM: Artificial Sequence
<220> FEATURE:
<223> OTHER INFORMATION: Seasonal H1N1 Reverse

<400> SEQUENCE: 5 gtggttgggc catgagcttt cttt 24

<210> SEQ ID NO 6
<211> LENGTH: 28
<212> TYPE: DNA
<213> ORGANISM: Artificial Sequence
<220> FEATURE:
<223> OTHER INFORMATION: Seasonal H1N1 Probe; comprising 6-

-continued

```
      carboxyfluorescein (FAM) at the 5' end and 6-
      carboxytetramethylrhodamine (TAMRA) at the 3' end.
<220> FEATURE:
<221> NAME/KEY: misc_binding
<222> LOCATION: (1)..(1)
<223> OTHER INFORMATION: 6-carboxyfluorescein (FAM)
<220> FEATURE:
<221> NAME/KEY: misc_binding
<222> LOCATION: (28)..(28)
<223> OTHER INFORMATION: 6-carboxytetramethylrhodamine (TAMRA)

<400> SEQUENCE: 6

gaggaactga gggagcaatt gagttcag                                    28
```

What is claimed is:

1. A reagent fluid dispensing device, comprising:

a chamber for receiving a reagent fluid, the chamber having a first opening and a second opening;

a first fluid conduit connected to the first opening of the chamber;

a reservoir dimensionalized for storing a predetermined volume of the reagent fluid, and having a first opening and a second opening, wherein the first opening of the reservoir is connected to the first fluid conduit to form a passive valve and wherein the first fluid conduit extends upwardly away from the reservoir so that the reagent fluid flows from the reservoir to the first fluid conduit in an or partially in an upward direction against gravity;

a pneumatic conduit connected to the second opening of the chamber, wherein the pneumatic conduit extends upwardly away from the chamber and is connectable to a pneumatic system, such that a first pneumatic pressure is applicable to the chamber by the first pneumatic system through the pneumatic conduit so that the predetermined volume of the reagent fluid is transferred from the reservoir to the chamber through the first fluid conduit; and a second fluid conduit connected to the second opening of the reservoir to allow flow of the reagent fluid to the reservoir, wherein the second fluid conduit is connectable to a second pneumatic system, such that a second pneumatic pressure is applicable to the second fluid conduit so that the reagent fluid in the second fluid conduit by the second pneumatic system is flushed from the second fluid conduit while the predetermined volume of the reagent fluid is present in the reservoir.

2. The reagent fluid dispensing device of claim 1, wherein the second pneumatic pressure is applicable to the reagent fluid through the second fluid conduit so that the reagent fluid is transferred from the reservoir to the chamber through the first fluid conduit.

3. The reagent fluid dispensing device of claim 1, wherein the resultant of the first pneumatic pressure to the chamber through the pneumatic conduit and the second pneumatic pressure to the reagent fluid through the second fluid conduit is greater than the pressure required to transfer the reagent fluid through the passive valve.

4. The reagent fluid dispensing device of claim 1, wherein the passive valve has a cross-sectional area that is the same as or smaller than the cross-sectional area of the first fluid conduit.

5. The reagent fluid dispensing device of claim 4, wherein the ratio of the cross-sectional area of the passive valve to the cross-sectional area of the first fluid conduit is between about 1:1 and about 1:2500.

6. The reagent fluid dispensing device of claim 1, wherein the reservoir has a cross-sectional area that is greater than that the cross-sectional area of the passive valve, wherein the ratio of the cross-sectional area of the passive valve to the cross-sectional area of the reservoir is between about 1:4 and about 1:4000.

7. The reagent fluid dispensing device of claim 1, wherein the reservoir has a volume of between about 1 μl and about 50 μl.

8. The reagent fluid dispensing device of claim 1, wherein at least one of the first opening and the second opening of the chamber is at a level above a liquid level in the chamber.

9. The reagent fluid dispensing device of claim 1, wherein the chamber has wax formed on at least a portion of the interior wall of the chamber.

10. The reagent fluid dispensing device of claim 1, wherein at least a portion of the inner surface of the reagent fluid dispensing device is hydrophobic.

11. A micro-fluidic device comprising a plurality of reagent fluid dispensing devices arranged in fluid communication with each other, each reagent fluid dispensing device comprising:

a chamber for receiving a reagent fluid, the chamber having a first opening and a second opening;

a first fluid conduit connected to the first opening of the chamber;

a reservoir dimensionalized for storing a predetermined volume of the reagent fluid, and having a first opening and a second opening, wherein the first opening of the reservoir is connected to the first fluid conduit to form a passive valve, wherein the first fluid conduit extends upwardly away from the reservoir so that the reagent fluid flows from the reservoir to the first fluid conduit in an or partially in an upward direction against gravity;

a pneumatic conduit connected to the second opening of the chamber, wherein the pneumatic conduit extends upwardly away from the chamber and is connectable to a first pneumatic system, such that a first pneumatic pressure is applicable to the chamber by the first pneumatic system through the pneumatic conduit so that the predetermined volume of the reagent fluid is transferred from the reservoir to the chamber through the first fluid conduit; and a second fluid conduit connected to the second opening of the reservoir to allow flow of the reagent fluid to the reservoir, wherein the second fluid conduit is connectable to a second pneumatic system, such that a second pneumatic pressure is applicable to the second fluid conduit by the second pneumatic system so that the reagent fluid in the second fluid conduit is flushed from the second fluid conduit while the predetermined volume of the reagent fluid is present in the reservoir.

12. A method of dispensing a reagent fluid, the method comprising:

providing a reagent fluid dispensing device, comprising a chamber for receiving a reagent fluid, the chamber having a first opening and a second opening, a first fluid conduit connected to the first opening of the chamber, a reservoir dimensionalized for storing a predetermined volume of the reagent fluid, and having a first opening and a second opening, wherein the first opening of the reservoir is connected to the first fluid conduit to form a passive valve, wherein the first fluid conduit extends upwardly away from the reservoir so that the reagent fluid flows from the reservoir to the first fluid conduit in an or partially in an upward direction against gravity, a pneumatic conduit connected to the second opening of the chamber, wherein the pneumatic conduit extends upwardly away from the chamber and is connectable to a first pneumatic system, such that a first pneumatic pressure is applicable to the chamber by the first pneumatic system through the pneumatic conduit so that the predetermined volume of the reagent fluid from the reservoir is transferred to the chamber through the first fluid conduit; and a second fluid conduit connected to the second opening of the reservoir to allow flow of the reagent fluid to the reservoir, wherein the second fluid conduit is connectable to a second pneumatic system, such that a second pneumatic pressure is applicable to the second fluid conduit by the second pneumatic system so the reagent fluid in the second fluid conduit is flushed from the second fluid conduit while the predetermined volume of the reagent fluid is present in the reservoir;

providing a reagent fluid in the reservoir; and applying pneumatic pressure to the chamber through the pneumatic conduit to transfer the predetermined volume of the reagent fluid from the reservoir to the chamber through the first fluid conduit.

13. The method of claim 12, wherein providing the reagent fluid in the reservoir comprises allowing the reagent fluid to flow through the second fluid conduit to the reservoir.

14. The method of claim 13, further comprising flushing the second fluid conduit while the predetermined volume of the reagent fluid is contained substantially within the reservoir.

15. The method of claim 12, further comprising applying pneumatic pressure to the reagent fluid through the second fluid conduit to transfer the reagent fluid from the reservoir to the chamber through the first fluid conduit.

16. The method of claim 12, further comprising applying wax on at least a portion of the interior wall of the chamber.

17. The method of claim 16, wherein the wax is melted to form a layer of wax in the chamber prior to dispensing the reagent fluid in the chamber.

* * * * *